US008523088B2

(12) United States Patent
Mueller

(10) Patent No.: US 8,523,088 B2
(45) Date of Patent: Sep. 3, 2013

(54) PARTICLE SPRAYING

(75) Inventor: Peter J. Mueller, Manchester, NH (US)

(73) Assignee: Velcro Industries B.V., Willemstad, Curacao ( * ) Notice: Subject to any disclaimer, the term of this patent is extended or adjusted under 35 U.S.C. 154(b) by 297 days.

(21) Appl. No.: 13/008,564

(22) Filed: Jan. 18, 2011

(65) Prior Publication Data

US 2012/0181345 A1 Jul. 19, 2012

(51) Int. Cl.

| | |
|---|---|
| ***B05B 9/04*** | (2006.01) |
| ***B05B 7/04*** | (2006.01) |
| ***B05B 7/30*** | (2006.01) |
| ***B05B 7/28*** | (2006.01) |
| ***B05B 7/32*** | (2006.01) |
| ***A44B 18/00*** | (2006.01) |

(52) U.S. Cl.

USPC ..... 239/373; 239/310; 239/316; 239/318; 239/337; 239/340; 24/448

(58) Field of Classification Search

USPC ..... 239/1, 8, 10, 302, 310, 316, 318, 239/337, 340, 373, 526; 24/442, 444, 446–448

See application file for complete search history.

(56) References Cited

U.S. PATENT DOCUMENTS

| | | | | |
|---|---|---|---|---|
| 3,128,514 | A | 4/1964 | Parker et al. | |
| 3,494,006 | A | 2/1970 | Brumlik | |
| 4,288,036 | A | 9/1981 | Jubinville | |
| 4,894,060 | A * | 1/1990 | Nestegard | 604/391 |
| 5,188,263 | A | 2/1993 | Woods | |
| 5,450,983 | A | 9/1995 | Stern et al. | |
| 5,749,129 | A | 5/1998 | Murasaki et al. | |
| 6,056,901 | A | 5/2000 | Hamatani et al. | |
| 6,106,944 | A | 8/2000 | Heikkila et al. | |
| 6,112,945 | A | 9/2000 | Woods | |
| 6,352,184 | B1 | 3/2002 | Stern et al. | |
| 6,663,017 | B2 * | 12/2003 | Endres et al. | 239/311 |
| 6,666,352 | B1 | 12/2003 | Woods | |
| 6,769,628 | B1 * | 8/2004 | Vaage et al. | 239/152 |
| 7,226,001 | B1 | 6/2007 | Stern et al. | |
| 7,308,738 | B2 | 12/2007 | Barvosa Carter et al. | |

(Continued)

FOREIGN PATENT DOCUMENTS

| | | | |
|---|---|---|---|
| EP | 1810754 | A1 | 7/2007 |
| GB | 2399496 | A | 9/2004 |
| WO | WO0133989 | A1 | 5/2001 |
| WO | WO2010050831 | A1 | 5/2010 |

OTHER PUBLICATIONS

International Search Report and Written Opinion for Application No. PCT/US/2011/046361; dated Dec. 8, 2011; 10 pages.

(Continued)

*Primary Examiner* — Darren W Gorman
(74) *Attorney, Agent, or Firm* — Fish & Richardson P.C.

(57) ABSTRACT

A particle sprayer includes a source of discrete particles, a spray outlet coupled to the particle source, and a conduit extending from a pressurized fluid inlet to the spray outlet and configured to constrain a flow of carrier fluid to flow along the conduit toward the spray outlet to propel particles from the particle source away from the spray outlet. The particles including discrete fastening bits having one or more projections, with each projection having an overhanging head for snagging fibers. The particle sprayer may be used to spray fastening bits onto a surface, to turn the surface into a touch fastener.

19 Claims, 18 Drawing Sheets

(56) References Cited

U.S. PATENT DOCUMENTS

| | | | |
|---|---|---|---|
| 7,374,068 | B2 | 5/2008 | Greer |
| 7,487,893 | B1 | 2/2009 | Greer et al. |
| 7,784,649 | B2 | 8/2010 | Greer |
| 8,082,637 | B2 | 12/2011 | Tolan et al. |
| 2005/0181171 | A1 | 8/2005 | Ausen et al. |
| 2005/0181352 | A1 | 8/2005 | Shephard et al. |
| 2008/0021144 | A1 | 1/2008 | Stahlberg et al. |
| 2009/0068463 | A1 | 3/2009 | Mochizuki et al. |
| 2009/0130443 | A1 | 5/2009 | Lustiger |
| 2009/0188948 | A1 | 7/2009 | Stern et al. |

OTHER PUBLICATIONS

International Search Report and Written Opinion for Application No. PCT/US/2012/021662; dated Apr. 20, 2012; 11 pages.

Texture Paint Spray Gun; Model 66103; Set Up and Operating Instructions; Central Pneumatic; Distributed exclusively by Harbor Freight Tools, 2008; 13 pages.

International Preliminary Report on Patentability and Written Opinion; Baharlou; Feb. 14, 2013; World Intellectual Property Organization (WIPO) (International Bureau of); PCT/US/2011/046361; 7 pages.

* cited by examiner

PARTICLE SPRAYING

TECHNICAL FIELD

This invention relates to particle spraying, and more particularly to spraying discrete fastening bits towards a support surface to which the sprayed bits adhere.

BACKGROUND

Mechanical touch fasteners are traditionally formed by weaving methods, or by molding discrete fastener elements on a substrate. Applying such touch fasteners to larger surfaces, such as a wall or floor, can involve positioning and adhering a section of touch fastener to the surface, often positioning several small sections of touch fastener to cover a large area. Non-planar surfaces in particular can be difficult to cover, even with large (e.g., stretched) webs of touch fastener material. Other means of providing surfaces with touch fastening properties are sought, particularly to releasably engage such surfaces with fibrous loop fasteners.

SUMMARY

One aspect of the invention features a particle sprayer including a particle source, a spray outlet coupled to the particle source, and a conduit extending from a pressurized fluid inlet to the spray outlet and configured to constrain a flow of carrier fluid to flow along the conduit toward the spray outlet to propel particles from the particle source away from the spray outlet, the particles including discrete fastening bits having one or more projections, with each projection having an overhanging head for snagging fibers.

In some cases, the particle source is releasably coupled to the spray outlet.

In some examples, the particle source is provided in the form of a reservoir in which a quantity of particles is contained. In some applications, the reservoir may be an enclosed and/or hermetically sealed container. Examples of a suitable container may include, but are not limited to, a can, a bottle, a jug, or a bag. In some embodiments, the container is of an appropriate size to be hand held by a user.

In some instances, the reservoir defines an opening for replenishing sprayed particles.

In some cases, the reservoir contains a carrier fluid. The reservoir may contain a selected ratio of particles or bits to carrier fluid. In some instances, the carrier fluid is motivated by a propellant. Examples of a suitable propellant may include, but are not limited to, an inert gas, compressed air, or a liquefied gas (e.g., compressed butane). In some embodiments, the carrier fluid is provided in the form of a foam, a liquefied gas, or a low viscosity liquid. In some applications, the carrier fluid includes an adhesive (such as a solvent based adhesive). In some cases, the particles are distributed substantially uniformly in the carrier fluid at rest. In some instances, the viscosity of the carrier fluid is sufficient to hold the particles in suspension when the carrier fluid is at rest. The carrier fluid may include one or more suspending agents (such as a thixotropic agent). In some cases, the density of the carrier fluid is approximately equal to the density of the particles, such that the particles have neutral buoyancy in the carrier fluid.

In some implementations, the particle sprayer is provided with a loose mixing element (such as a stainless steel ball) for dispersing the particles in the carrier fluid.

In some applications, the particle sprayer further includes a venturi constriction in hydraulic communication with the reservoir for siphoning particles from the reservoir. Preferably, the venturi constriction causes a low pressure region (such as a vacuum region) to form proximate an opening in the reservoir when a fluid flows through the constriction.

In some examples, the particle sprayer further includes a pump for injecting a propellant into the reservoir. The pump may be provided in the form of a hand operated pump or a pump driven by an electric motor.

In some embodiments, the particle sprayer further includes a fluid source coupled to the pressurized fluid inlet. The fluid source may be externally located with respect to the other components of the particle sprayer.

In some applications, the fluid source is placed in fluid communication with the pressurized fluid inlet.

In some instances, the fluid source is provided in the form of a reservoir containing a quantity of fluid.

In some cases, the fluid source includes a pump (such as a hand operated pump or a pump driven by an electric motor) for injecting fluid into the conduit. The fluid may be a carrier fluid or a propellant.

In some embodiments, the particle sprayer further includes a longitudinally continuous ribbon and a cutter for cutting through the ribbon at discrete intervals to form the discrete fastening bits. The ribbon may define a longitudinal axis and the cutter may be configured to cut completely through the ribbon along the longitudinal axis of the ribbon. In some cases, the cutter is mounted to an outer edge of a wheel. The cutter preferably includes a solid cutting edge. The cutting edge may form an acute cutting angle. In some examples, the ribbon includes a polymeric resin containing a thermoplastic.

In some implementations, the particle sprayer further includes a support surface coupled to the cutter for supporting a portion of the ribbon during use. The support surface may be provided in the form of a bed knife.

In some embodiments, the particle sprayer further includes a conveyor coupled to the cutter for feeding the ribbon towards the cutter. The conveyor may include a single feed roll or a pair of counter rotating feed rolls.

In some examples, the particle sprayer further includes a valve in hydraulic communication with the particle source for dispensing particles. The valve may be provided in the form of an aerosol valve or a metering game. In some cases, the valve includes a plunger. In some applications, the valve includes an opening of sufficient size to dispense particles (such as discrete fastening bits).

In some implementations, the particle sprayer further includes a suitable actuator coupled to the valve for adjusting the valve between opened and closed positions. Examples of a suitable actuator include, but are not limited to, a spring biased trigger, a rotatable knob, or a spring biased plunger.

In some cases, the spray outlet includes an opening of sufficient size to eject discrete fastening bits. Preferably, the opening or orifice includes an open area of at least about 1.1 square millimeters.

In some embodiments, the spray outlet includes a nozzle. The nozzle may be placed in hydraulic communication with a fluid source. In some cases, the nozzle includes an opening of sufficient size to eject or propel particles (such as discrete fastening bits). In some examples, the nozzle defines a first orifice and a second orifice, the first orifice being configured to eject bits and the second orifice being configured to eject fluid. Preferably, the first orifice includes an open area of at least about 1.1 square millimeters and the second nozzle includes an open area of at least about 0.1 square millimeter.

In some cases, a multiplicity of the bits are highly hydrophilic.

In some applications, a multiplicity of the bits are statically charged.

In some embodiments, a multiplicity of the bits include one or more compressible portions.

In some examples, a multiplicity of the bits include one or more pliable portions.

In some implementations, a multiplicity of the bits include one or more porous portions.

In some instances, a multiplicity of the bits include one or more elastically deformable portions.

In some embodiments, a multiplicity of the bits are aerodynamically included to land on a support surface in a selected orientation when sprayed. The selected orientation is characterized by the bit having at least one projection head extending away from the support surface.

In some examples, each bit includes a quantity of adhesive, the bits being configured to release the adhesive upon impact with a support surface.

In some cases, each bit includes opposite side surfaces defining the projections. One, or both, of the opposite side surfaces of each bit may be non-planar.

In various touch fastening applications, each projection head defines a crook for releasably snagging fibers.

In some instances, each bit has an overall thickness, measured between side surfaces, that is less than the maximum overall linear dimension of the bit.

In some embodiments, all linear dimensions of each bit are less than about 1.2 millimeters.

In many cases, a multiplicity of the bits are of an average bit size less than about three millimeters across.

In some examples, all or substantially all of the particles are discrete fastening bits.

Yet another aspect of the invention features a particle sprayer including a reservoir containing a multiplicity of particles, a valve in hydraulic communication with the reservoir for dispensing particles from the reservoir, and a nozzle coupled to the reservoir for spraying particles dispensed by the valve, the particles including discrete fastening bits, each bit having one or more projections, with each projection having an overhanging head for snagging fibers.

Yet another aspect of the invention features a particle sprayer including a source of particles, means for displacing the particles from the source, and means for propelling the particles away from the source towards a support surface in a spray, the particles including discrete fastening bits, each bit having one or more projections, with each projection having an overhanging head for snagging fibers.

Yet another aspect of the invention features a method of spraying particles. The method includes providing a particle sprayer, the particle sprayer including a particle source, a spray outlet coupled to the particle source, a conduit extending from a pressurized fluid inlet to the spray outlet and configured to constrain a flow of carrier fluid to flow along the conduit toward the spray outlet to propel particles from the particle source away from the spray outlet, and an actuator coupled to the conduit and configured to initiate spraying of the particles, the particles including discrete fastening bits having one or more projections, with each projection having an overhanging head for snagging fibers. The method further includes operating the actuator to initiate particle spraying.

Various embodiments can provide a very flexible means of adding fastening bits to a pre-formed surface, either to produce a touch fastening material that is later applied to another surface, or to impart touch fastening properties directly to an otherwise functional surface, such as a surface of a building, or to a curved surface. Some examples of the methods described herein will be considered appropriate for implementation by contractors or other skilled users, while others may be performed by untrained operators, such as with sprayers purchased at retail stores. In some cases the supply of bits may be replenished, such as by replacement reservoirs or from bulk bags. In some other cases, the sprayer will be designed for disposal when the quantity of bits is exhausted. In some examples, the sprayer may be a part of a fastener manufacturing line; in some other cases it may be portable for carrying to a worksite.

The details of one or more embodiments of the invention are set forth in the accompanying drawings and the description below. Other features, objects, and advantages of the invention will be apparent from the description and drawings, and from the claims.

DESCRIPTION OF DRAWINGS

Like reference symbols in the various drawings indicate like elements.

DETAILED DESCRIPTION

Figure 1:
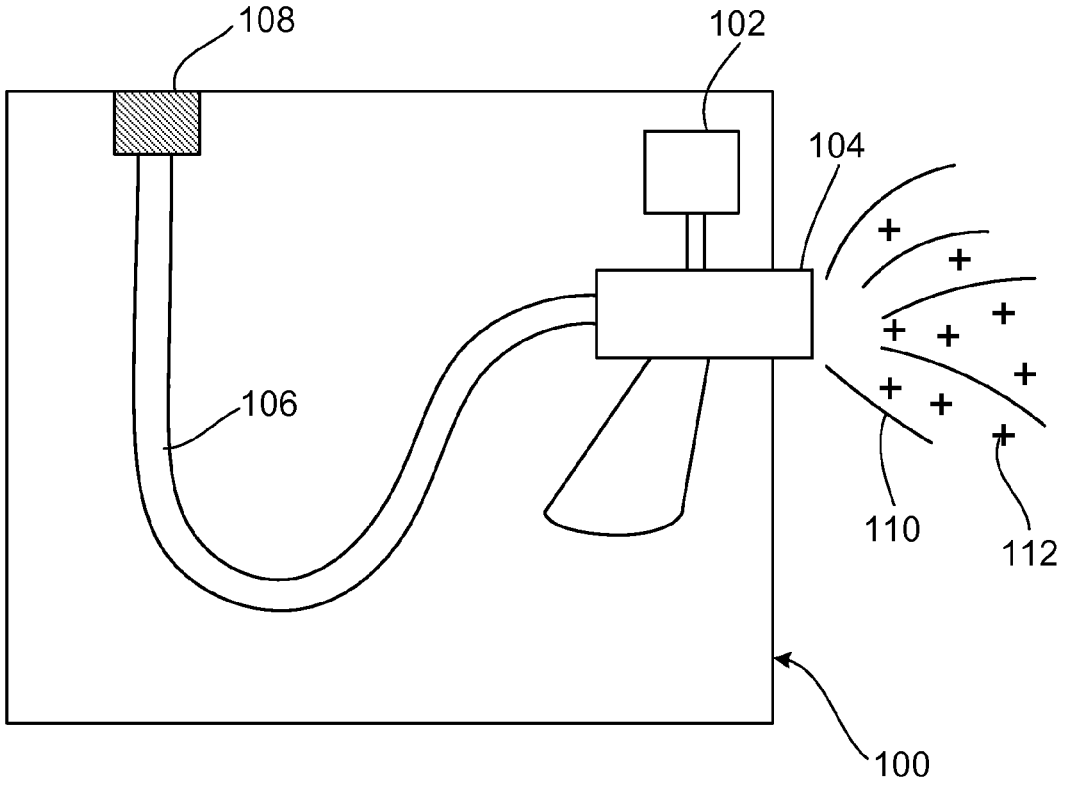
FIG. 1 is a schematic representation of a particle sprayer.

FIG. 1 shows a schematic view of a particle sprayer 100 that may be used to form a touch fastener product (e.g., touch fastener product 204, see FIG. 10), or to otherwise spray fastening particles onto a support surface or substrate. As shown, particle sprayer 100 includes a particle source 102 coupled to a spray outlet 104, and a conduit 106 extending from a pressurized fluid inlet 108 to the spray outlet. Conduit 106 is configured to constrain a flow of carrier fluid 110 to flow along the conduit toward spray outlet 104 to propel particles 112 provided by particle source 102 away from the spray outlet. As used herein, the term "carrier fluid" refers to any fluid (e.g., a gas, liquid, or a combination of both) carrying and/or motivating particles 112 as the particles are sprayed. The particles 112 include discrete fastening bits (e.g., bits 180, see FIG. 10). In some examples, all or substantially all of particles 112 are discrete fastening bits.

Figure 2B:
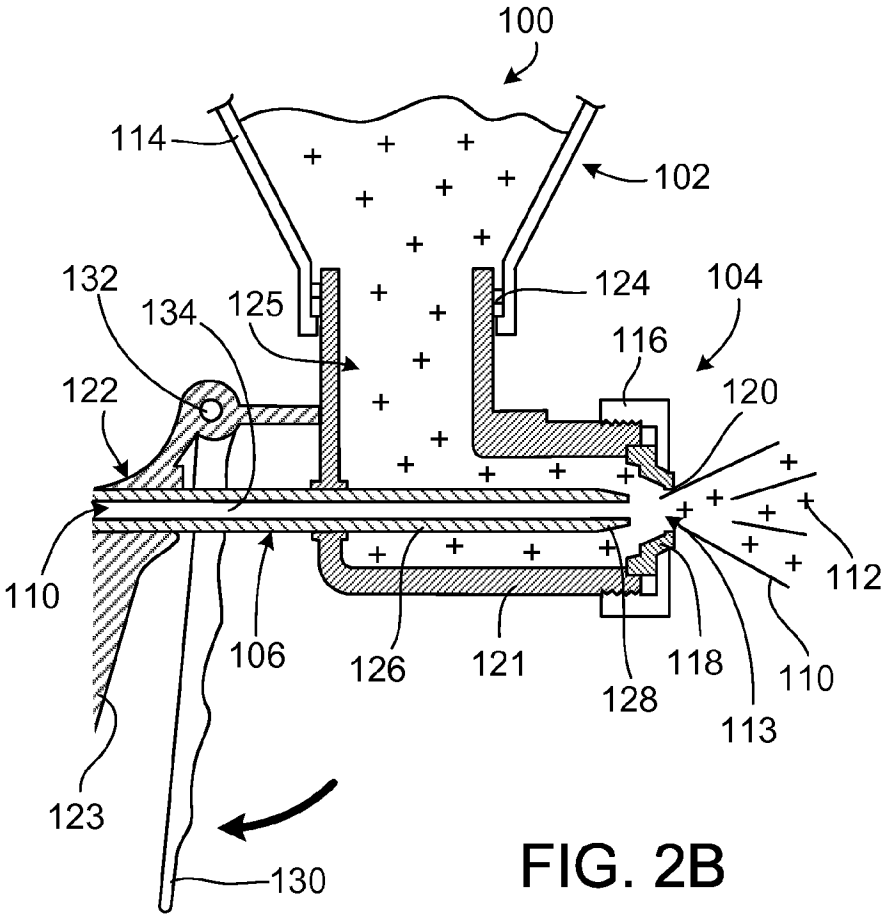
FIGS. 2A and 2B are cross-sectional views of a first particle sprayer.
Figure 2A:
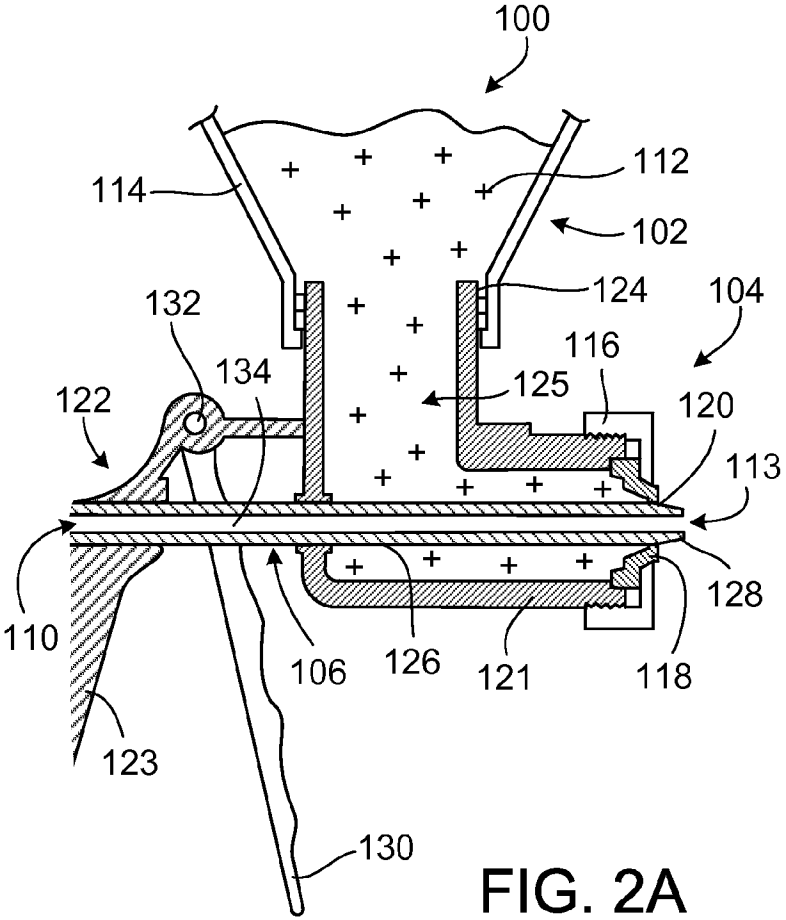

FIGS. 2A and 2B show a first example of a particle sprayer 100 in use. In this example, particle sprayer 100 is provided with a particle source 102 in the form of a reservoir 114 containing a quantity of particles 112, which may either be dry, loosely packed particles or particles mixed in a liquid or semiliquid binder (e.g., a hardenable liquid such as adhesive 224, see FIG. 10). If mixed in a liquid binder that is to form a coating on a surface onto which the particles and binder are sprayed, the mixture should contain a selected ratio of particles 112 to binder in order to achieve a desired surface coating. Reservoir 114 is placed in hydraulic communication with a spray outlet 104 by operation of a valve, as discussed below. Spray outlet 104 features a cap 116 housing a frustoconical nozzle 118 having an orifice 120 for discharging particles 112 and carrier fluid 110. Orifice 120 should be of a size suitable to discharge particles 112 at sufficient velocity to propel the particles away from the sprayer. In this example, orifice 120 is circular. For some particle shapes and sizes discussed below, orifice 120 has an open area of at least about 1.1 square millimeters. Reservoir 114 and nozzle 118 are each releasably coupled to a sprayer body 122. In this example, the sprayer body 122 includes a barrel 121 and a handle 123.

Reservoir 114 is funnel-shaped, with its smaller opening 124 in hydraulic communication with a hollow portion 125 of sprayer body 122. Reservoir 114 may be formed of any material suitable to hold particles 112 and any associated fluid (e.g., a liquid binder). Reservoir 114 is positioned above sprayer body 122 such that the particles are urged by gravity toward opening 124. If containing dry particles, the reservoir shape should be selected in accordance with dry packing properties of the particles, to keep the particles from packing in the reservoir and starving the sprayer. Dry flow additives may be included.

Particle sprayer 100 also includes a rigid conduit tube 126 that forms the downstream end of a conduit 106 which is coupled to an external pressurized fluid source (not shown). Conduit tube 126 extends through hollow portions 125 of sprayer body 122 from a pressurized fluid inlet of the sprayer body (in this example, a standard pneumatic quick-connect fitting, not shown, for attaching the sprayer to an air compressor or compressed air tank). Conduit tube 126 has a rigid tubular body terminating in a frustoconical outlet 128 that seats against an inner surface of nozzle 118. Any communication between reservoir 114 and nozzle orifice 120 is blocked when conduit outlet 128 is pressed against the inner surface of nozzle 118. During use, conduit tube 126 delivers a flow of carrier fluid 110 from the pressurized fluid source to outlet 128.

As shown, outlet 128 and nozzle 118 cooperate to form a needle valve 113 in hydraulic communication with reservoir 114 for dispensing particles 112 into a stream of carrier fluid 110 such as air. A biasing member (in this example, a helical compression spring, not shown, disposed between a portion of sprayer body 122 and conduit tube 126) is used to urge outlet 128 towards nozzle 118. An actuator 130 (in this example, a trigger) for adjusting the needle valve between opened and closed positions is pivotally coupled to sprayer body 122 by a pin 132 and to tube 126 by another pin 134. As used herein, the term "opened position" refers to any valve position resulting in flow through the valve. Likewise, as used herein, the term "closed position" refers to the valve position in which flow through the valve is mostly blocked.

FIG. 2A shows particle sprayer 100 with the needle valve in a closed position. FIG. 2B shows particle sprayer 100 with the needle valve is in an opened position. As shown, when actuator 130 is pulled towards sprayer handle 123, the backwards pivoting motion of the actuator causes conduit outlet 128 to be refracted from nozzle 118, thereby opening the valve by providing an annular opening 136 through which particles 112 are dispensed. Once particles 112 are dispensed by the needle valve, they are carried through nozzle orifice 120 and towards a support surface (not shown) by carrier fluid 110 discharged from conduit outlet 128.

While in the illustrated example the carrier fluid continues to flow even with the trigger released, in a similar example actuator 130 also operates a pneumatic valve that opens in concert with needle valve 113, such that when the trigger is released no carrier fluid is flowing along conduit 106.

Figure 3B:
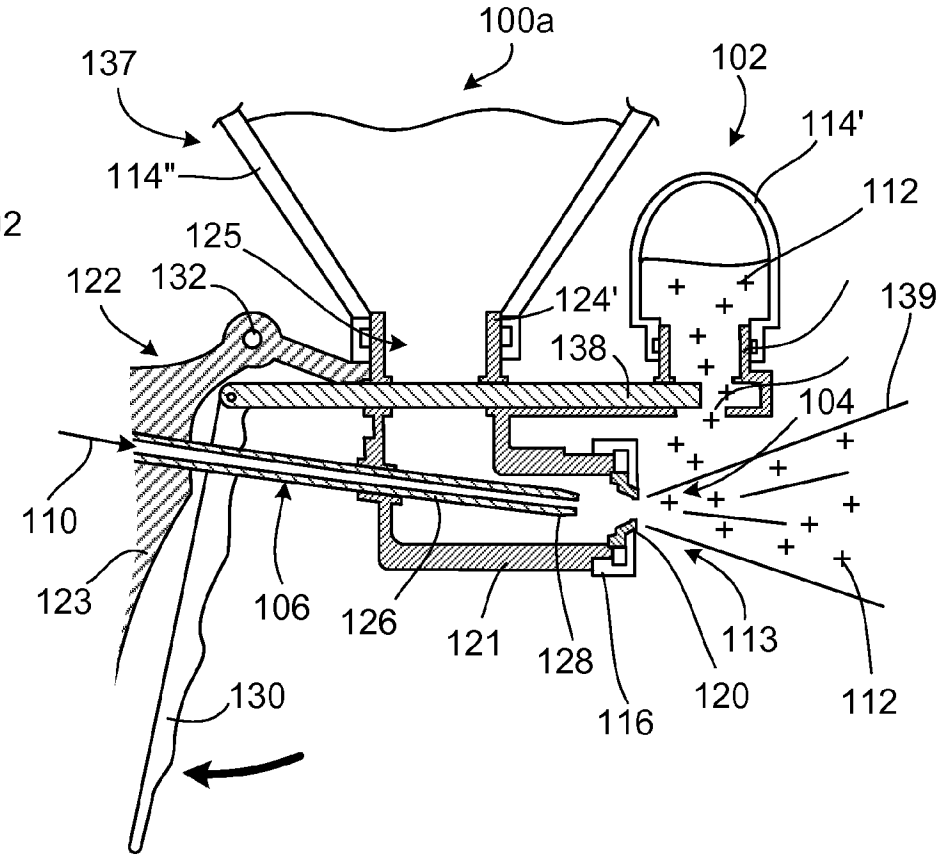
FIGS. 3A and 3B are cross-sectional views of a second particle sprayer.
Figure 3A:
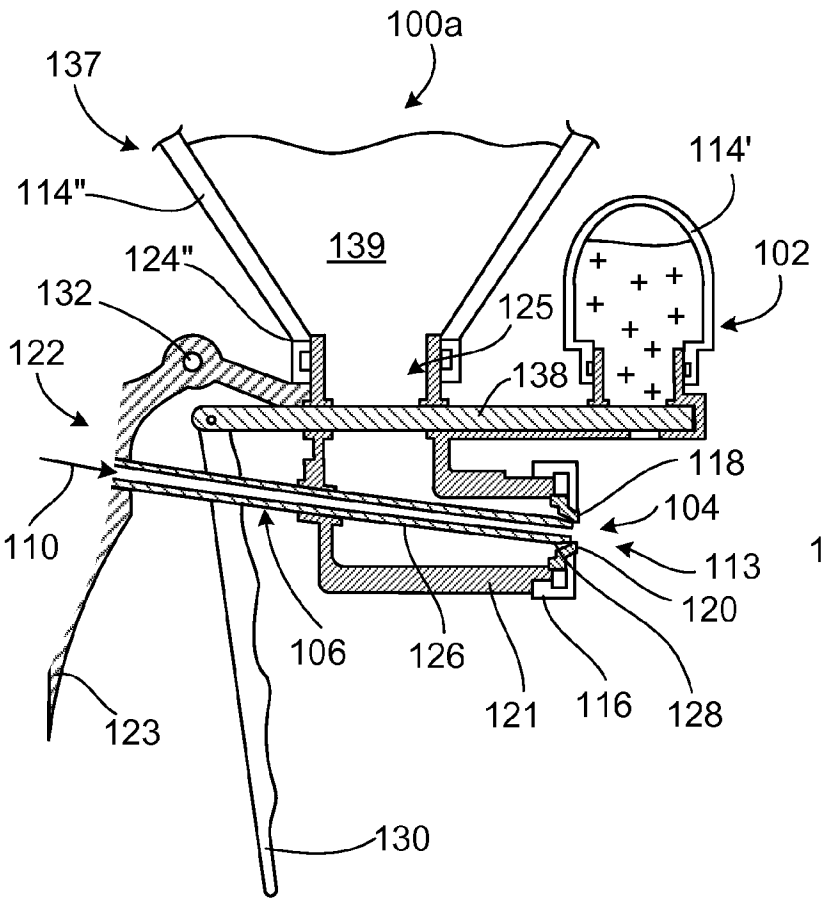

FIGS. 3A and 3B show another particle sprayer 100 similar to the particle sprayer shown in FIGS. 2A and 2B. In this example, particle sprayer 100*a* has a particle source 102 in the form of a first reservoir 114' containing a quantity of dry particles 112. The particle sprayer also includes a fluid source 137 in the form of a second reservoir 114" containing a liquid binder 139. First reservoir 114' and second reservoir 114" are placed in hydraulic communication with a spray outlet 104 by operation of a metering gate and a valve, respectively, as discussed below. Spray outlet 104 features a cap 116 housing a frustoconical nozzle 118 defining an orifice 120 for discharging liquid binder 139 into the flow of carrier fluid 110. In this example, first reservoir 114', second reservoir 114", and nozzle 118 are each releasably coupled to a sprayer body 122. As in the previous example, the sprayer body includes a barrel 121 and a handle 123.

As shown, first reservoir 114' is a cylindrical capsule having an opening 124' at the bottom end of a size suitable for releasing particles 112. Second reservoir 114" is funnel-shaped, with its smaller opening 124" in hydraulic communication with a hollow portion 125 of sprayer body 122. As in the previous example, particle sprayer 100 also includes a conduit 106 having a rigid conduit tube 126. A distal end 128 of conduit tube 126 is pressed against an inner surface of the nozzle to form a needle valve for dispensing liquid binder 139 from second reservoir 114". An actuator 130 coupled to sprayer body 122 and tube 126 is used for adjusting the needle valve and a metering gate (discussed below) between opened and closed positions. Metering gate 138 is aligned with opening 124' for dispensing particles 112 from second reservoir 114". A trailing end of metering gate 138 is fixedly coupled to actuator 130 and a leading end of the metering gate traverses reservoir opening 124'.

FIG. 3A shows particle sprayer 100*a* with both the needle valve and metering gate 138 in closed positions. FIG. 3B shows the particle sprayer with both the needle valve and metering gate 138 in opened positions. As shown, when actuator 130 is pulled towards sprayer handle 123, the backward pivoting motion of the actuator causes conduit tube 126 to be retracted from nozzle 118, thereby providing an annular opening 136 through which liquid binder 139 is dispensed. The pivoting motion of actuator 130 also causes metering gate 138 to be drawn back across opening 124', thereby providing an orifice 140 through which particles 112 are dispensed by gravity. In this example, orifice 140 is provided with an open area of sufficient size to dispense discrete fastening bits. Once dispensed, liquid binder 139 is propelled through nozzle orifice 120 by carrier fluid 110 discharged from the conduit tube. As shown, particles 112 are released into a spray of liquid binder 139 and carrier fluid 110 and propelled away from the sprayer. In some examples, bits or particles 112 are configured (e.g., provided having the correct geometry and/or size) such that they are only partially wetted by the liquid binder in the spray. For instance, only one portion of each of the bits may be wetted by the liquid binder, leaving the other portions of the bits dry as fixed to a support surface of a touch fastener product.

In yet another example, the conduit tube 126 of the above example is replaced with a solid rod and reservoir 114" contains a pressurized carrier fluid, such that retracting actuator 130 retracts the solid rod to release a spray of carrier fluid that entrains the dispensed bits falling from opening 124'.

Figure 4A:
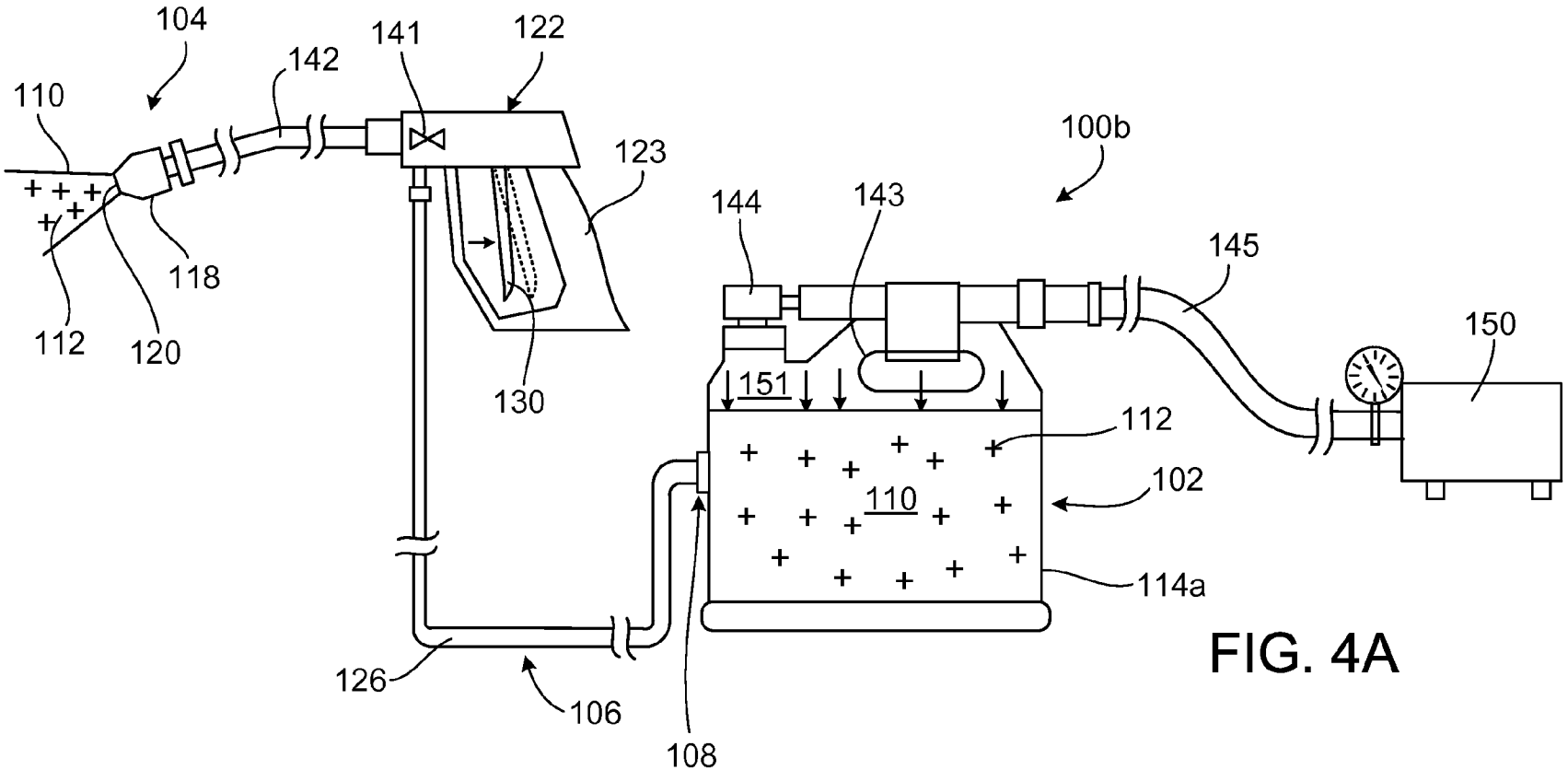
FIG. 4A is a side view of a third particle sprayer.

FIG. 4A shows yet another particle sprayer 100*b* in use. In this example, particle sprayer 100*b* is provided having a particle source 102 in the form of a reservoir 114*a* containing a quantity of particles 112 dispersed in a carrier fluid 110 (in this example, the carrier fluid includes a liquid binder or adhesive). Reservoir 114*a* is placed in hydraulic communication with a spray outlet 104 by a flexible conduit 126 in the form of a hose that forms the main body of a conduit 106. Conduit 106 also includes a pressurized fluid inlet 108 coupled to reservoir 114*a*. As shown, conduit 126 extends from pressurized fluid inlet 108 to spray outlet 104, where a downstream portion of the conduit tube is coupled to an operable valve 141 disposed in a sprayer body 122. Spray outlet 104 is provided in the form of a nozzle 118 having an orifice 120 configured to spray particles 112 carried by carrier fluid 110, and a rigid conduit 142 extending from sprayer body 122 to the nozzle. As in previous examples, sprayer body 122 includes a barrel 121, a handle 123, and an actuator 130.

As shown, reservoir 114*a* is a jug or other container including a handle 143 to facilitate transport of the reservoir by a user, an inlet 144 coupled to an external pressurized fluid source 150 (e.g., a propellant source) by way of a conduit 145, and an outlet at conduit inlet 108 for releasing a mixture of particles 112 and carrier fluid 110 to conduit 126. Propellant source 150 should be a suitable mechanical or pneumatic device for providing a pressurized flow of propellant 151 to reservoir 114*a*. In this example, propellant source 150 is a positive displacement, motor driven air pump. As used herein, the term "propellant" refers to any fluid motivating another fluid (e.g., a fluid imparting a motive force on another fluid). For instance, in this example, propellant 151 is pressurized air (e.g., provided by a pressurized fluid source). A fluid may be considered "pressurized" when a pressure greater than atmospheric pressure is exerted on the fluid. Once provided to reservoir 114*a*, propellant 151 bears down on carrier fluid 110 in which particles 112 are dispersed, thereby pushing the carrier fluid from the reservoir and through conduit 126. Particles 112 are carried from reservoir 114*a* by the flowing carrier fluid. The pressure exerted on carrier fluid 110 by propellant 151 should be sufficient to drive the carrier fluid from reservoir 114*a* and through nozzle orifice 120 at sufficient velocity to propel the carrier fluid and particles 112 away from the sprayer. Carrier fluid 110 and particles 112 are provided in a constrained flow by the conduit 126 to valve 141 which is coupled to actuator 130. Valve 141 is configured to dispense the mixture of carrier fluid 110 and particles 112 to spray outlet 104 in response to manual manipulation of actuator 130. For instance, in this example, pulling actuator 130 adjusts valve 141 to an opened position, thereby allowing the mixture of carrier fluid and particles to pass through the valve. Valve 141 is in hydraulic communication with spray outlet 104, such that when the valve is adjusted to an opened position, the mixture of carrier fluid 110 and particles 110 passes through rigid conduit 142 and is discharged through nozzle orifice 120 away from the sprayer.

Figure 4B:
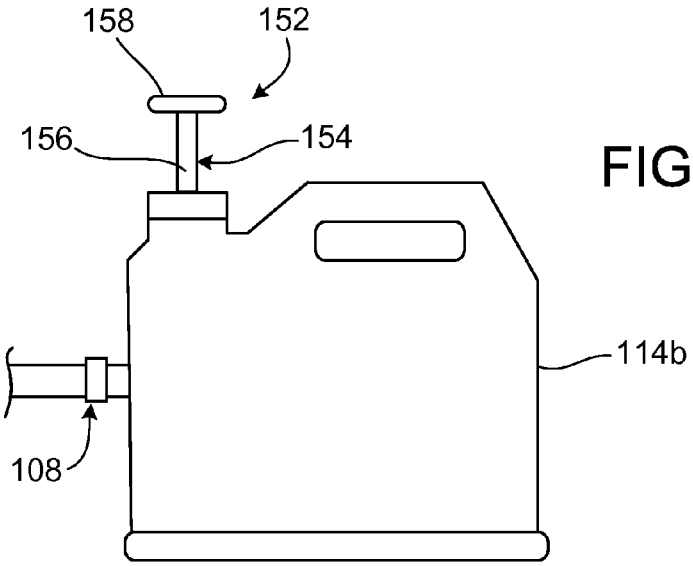
FIG. 4B is a side view of a reservoir that is suitable for use in the particle sprayer shown in FIG. 4A.

FIG. 4B shows an alternate reservoir 114*b* suitable for use in the particle sprayer 100*b* shown in FIG. 4A. In this example, reservoir 114*b* is provided in the form of a jug or other closed container having an integral pump assembly 152. Pump assembly 152 includes a pump casing (not shown) and a piston 154 mounted to the pump casing. The pump casing is configured to support reciprocating linear movement of piston 154. Piston 154 features a piston rod 156 and a handle 158. Handle 158 may be gripped by a user to displace piston rod 156 linearly inward and outward of the pump casing to inject a propellant (in this case ambient air) into reservoir 114*b*. In this manner a sufficient amount of propellant to drive the mixture of carrier fluid and particles from the reservoir to the spray outlet can be provided by repeated manual operation of pump assembly 152.

Figure 5:
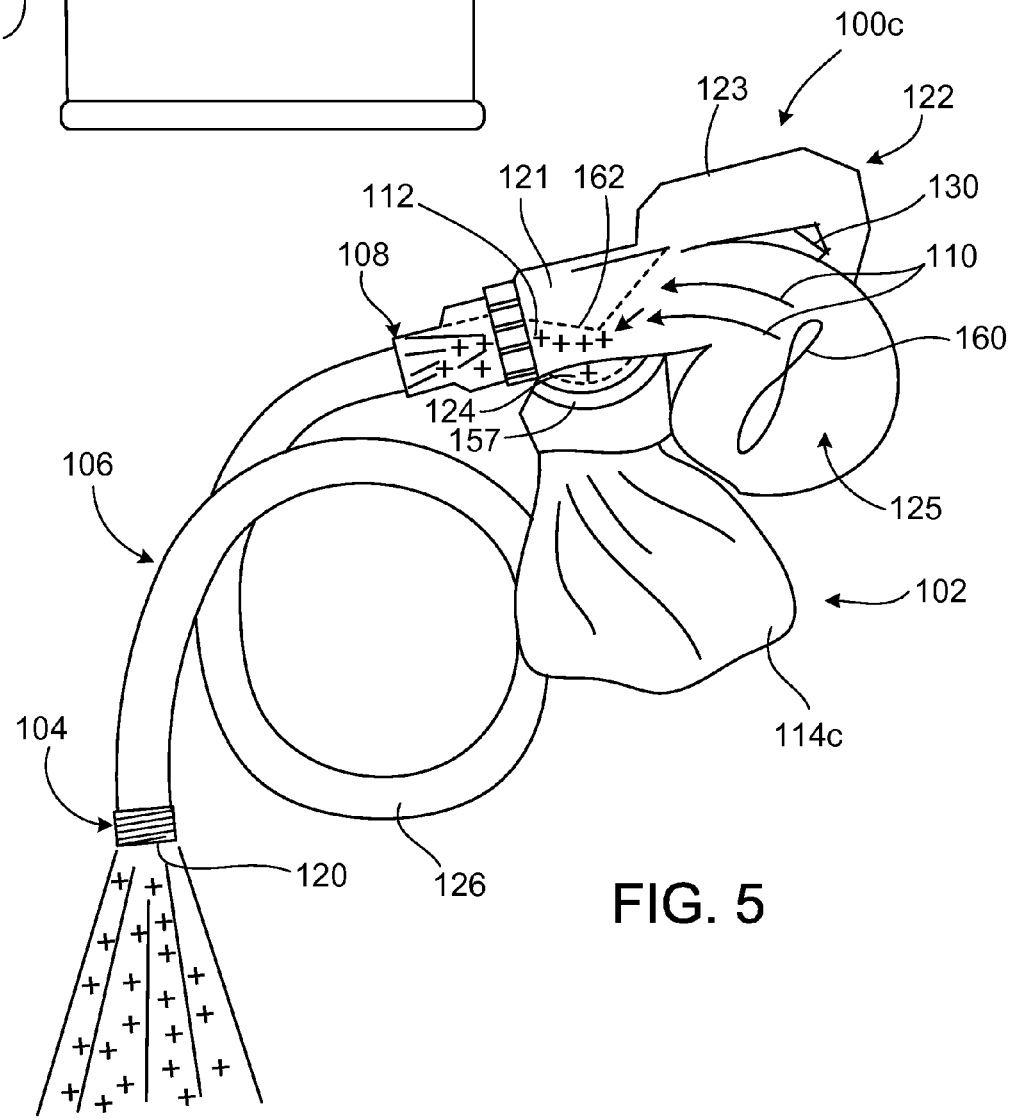
FIG. 5 is a side view of a fourth particle sprayer.

FIG. 5 shows a particle sprayer 100*c* having a particle source 102 in the form of a reservoir 114*c* containing a quantity of loosely packed, dry particles 112. Reservoir 114*c* is coupled to a sprayer body 122, the sprayer body including a handle 123, a barrel 121, and an actuator 130. In this example, the reservoir 114*c* is a flexible sack or a bag having an opening 124 and a coupling member 157 (e.g., in this example, a standard male or female quick coupling member cooperating with a counterpart member of sprayer body 122) securing the reservoir to the sprayer body. Particle sprayer 122 also includes a spray outlet 104 having an orifice 120 for discharging particles 112 in a flow of air as a carrier fluid 110. Spray outlet 104 is placed in fluid communication with reservoir 114 by a hose 126 which forms the main body of a conduit 106. The conduit 106 also includes a pressurized fluid inlet 108 which is coupled to the barrel of sprayer body 122.

As shown, particle sprayer 100*c* also includes a blower assembly 160 (depicted schematically) disposed within a hollow portion 125 of sprayer body 122. Blower assembly 160 should be configured to provide a flow of carrier fluid 110 for motivating particles 112 from reservoir 114*c* to spray outlet 104. In this example, blower assembly 160 features a motor driven, rotatable impeller mounted to sprayer body 122. The impeller includes a multiplicity of vanes configured to create a pressure differential on opposite sides of the impeller when the impeller is revolved rapidly by the motor. The pressure differential generates a flow of carrier fluid 110 (in this example, air) passing through sprayer barrel 121. Barrel 121 includes a venturi constriction 162 for syphoning particles 112 from reservoir 114*c*. Venturi constriction 162 is in hydraulic communication with the reservoir opening 124 and creates a low pressure region 164 (e.g., a vacuum region) formed proximate reservoir opening 124. The differential between low pressure region 164 and the ambient pressure of reservoir 114*c* is sufficient to siphon particles 112 from the reservoir and up into the flow of carrier fluid. The flowing carrier fluid 110 then carries the particles through conduit 126 and through orifice 120. The bag of reservoir 114*c* may be sufficiently porous to admit ambient air into the bag, or may be sealed but sufficiently flexible to collapse during use.

Figure 6A:
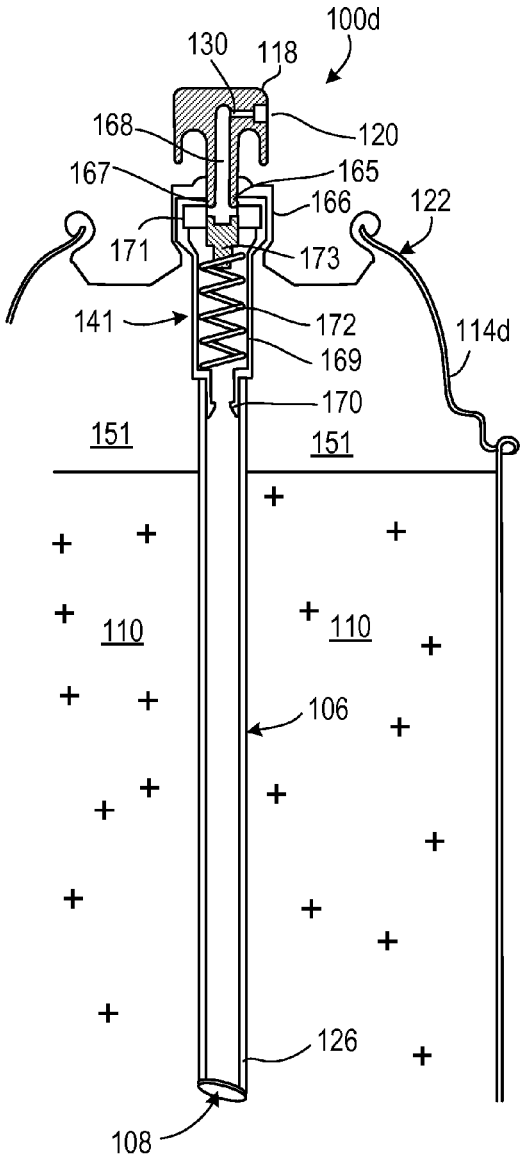
FIGS. 6A and 6B are cross-sectional views of a fifth particle sprayer.
Figure 6B:
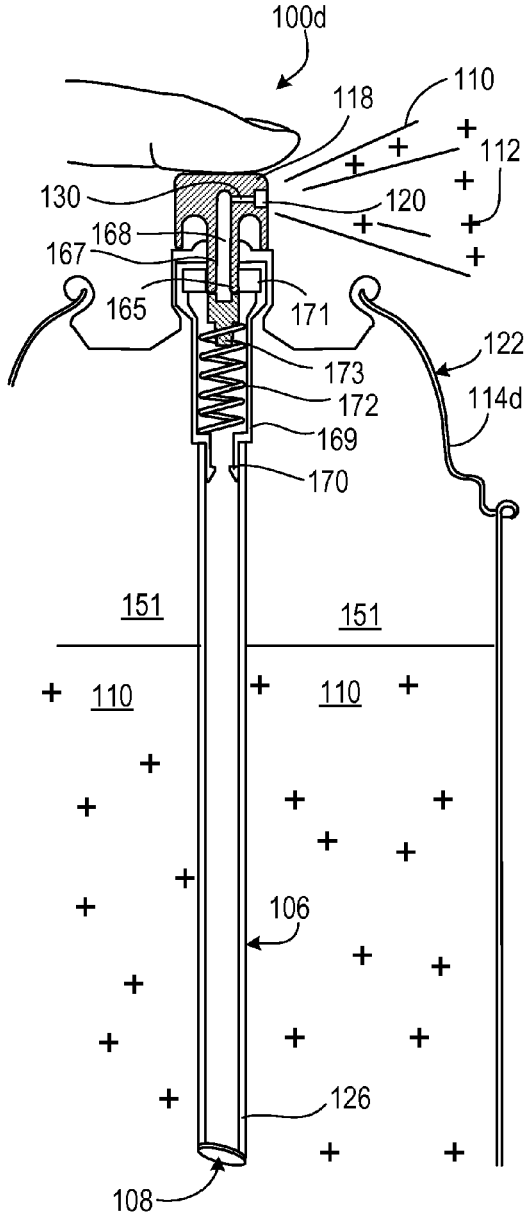

FIGS. 6A and 6B show a particle sprayer 100*d* in the form of an aerosol can. The can itself forms a reservoir 114*d* containing a quantity of particles 112, a carrier fluid 110 in which the particles are dispersed, and a pressurized propellant 151 (in this example, an inert gas) bearing down on the carrier fluid. Particles 112 should be dispersed evenly in carrier fluid 110 prior to spraying. In some examples, particles 112 are suspended in carrier fluid 110 when the carrier fluid is at rest. For instance, the viscosity of carrier fluid 110 is sufficient to hold particles 112 in suspension when the carrier fluid is at rest. In this example, the carrier fluid 110 may include one or more suspending agents for attaining a sufficient viscosity to suspend particles 112 in the carrier fluid. In particular, carrier fluid 110 may be formed of a liquid binder to which a thixotropic agent is added (e.g., about 0.3% and 5% by volume of fused silica). In some examples, the density of particles 112 and the density of carrier fluid 110 are matched so that the particles have neutral buoyancy in the carrier fluid, thereby allowing the particles to remain dispersed when the carrier fluid is at rest. In some examples, particles 112 are suspended in carrier fluid 110 by surface energy. For instance, particles 112 may be highly hydrophilic, causing them to disperse in carrier fluid 110 due to their interactions with the ions in the carrier fluid solution. In some examples, particles 112 are electrostatically suspended in carrier fluid 110. For instance, particles 112 may be statically charged such that they are motivated apart from one another, thereby creating a uniform semi-stable suspension of particles 112 in carrier fluid 110. In some examples, particles 112 are dispersed and/or suspended in a viscous foam or gel carrier fluid 110. In some examples, a liquid binder or hardenable fluid may be used as a carrier fluid (e.g., when creating a touch fastener product). For instance, in this example, carrier fluid 110 includes a quantity of V-Block PRIMER-SEALER, manufactured by APAC of 2424 Lakeland Road, Dalton, Ga. 30721 (www.apacadhesives.com).

In some cases, the fluid contents of the reservoir (e.g., a carrier fluid and/or a propellant) are not configured to hold the particles in a dispersed suspension. In such cases, the reservoir can be provided with a mixing element (such as a loose stainless steel ball) for dispersing the particles in the carrier fluid. For example, a user can shake the reservoir to agitate the mixing element and disperse the particles in the carrier fluid prior to spraying.

Reservoir 114*d* is a hermetically sealed can or bottle configured to contain one or more pressurized fluids. For instance, in this example, reservoir 114*d* is formed of a material with good tensile properties. As shown, reservoir 114*d* is an integral part of a sprayer body 122, the sprayer body also including an opening 165 in which a spray outlet 104 is disposed, and a valve cup 166. Spray outlet 104 features a nozzle 118 having an actuator 130, an outlet orifice 120, an inlet orifice 167, and a stem 168 hydraulically coupling the inlet orifice to the outlet orifice. Spray outlet 104 and reservoir 114 are placed in hydraulic communication by a conduit 106 cooperating with a valve 141, as discussed below.

A flexible conduit tube 126 forms the main body of conduit 106, the conduit also including a pressurized fluid inlet 108 and an outlet 170 coupled to valve 141. In this example, valve 141 features a housing 169 supported by a lower portion of valve cup 166, a sealing member 171 (in this example, an o-ring gasket) positioned between an upper portion of the valve housing and the valve cup, a biasing member 172 (in this example, a helical compression spring), and a plunger 173 coupled to nozzle 118. As shown, biasing member 172 and plunger 173 are disposed in valve housing 169.

FIG. 6A shows particle sprayer 100*d* with valve 141 in a closed position. As shown, when the valve is in a closed position, the force provided by biasing member 172 urges nozzle 118 upward (via plunger 173), such that inlet orifice 167 is pressed against sealing member 171. FIG. 6B shows valve 141 in an opened position. As shown, when a user presses on actuator 130 (and therefore plunger 173) with sufficient force, the upwards force provided by biasing member 172 is overcome, thereby allowing nozzle 118 to be urged downwards. As the nozzle is pressed downwards, inlet orifice 167 traverses sealing member 171 and is placed in hydraulic communication with conduit tube 126. At this point, there exists a passage from the pressurized reservoir to the ambient pressure (i.e., atmospheric pressure) environment. As such, propellant 151 is allowed to drive carrier fluid 110 from reservoir 114 through conduit house 126 and nozzle orifice 120. Particles 112 are carried from the reservoir by the motivated carrier fluid and subsequently sprayed from the nozzle orifice away from the sprayer.

As shown in FIGS. 6A and 6B, propellant 151 may be provided in the form of a pressurized inert gas. In some other examples, however, propellant 151 is provided in the form of a liquid or a liquefied gas (e.g., compressed butane). The liquefied gas may exist as a liquid when reservoir 114 is kept under high pressure (for example when valve 141 is closed). When the pressure on the liquefied gas is relieved (for example, when valve 141 is opened), some of the liquefied gas should begin to boil, thereby forming a layer of gas near the top of the reservoir bearing down on carrier fluid 110 and driving the carrier fluid as well as some of the liquefied gas through conduit tube 126 toward nozzle orifice 120. In some cases, liquefied gas driven from the reservoir can be used to increase the flowability of the particles. For example, a liquefied gas propellant having a lower viscosity than the carrier fluid can be provided to the particle sprayer. Additionally, in some examples, the evaporating liquefied gas propellant forms bubbles in the carrier fluid, creating a foam. By using a propellant in the form of a liquid or liquefied gas, the mixture may be further diluted as it is sprayed towards the support surface. The propellant may evaporate upon release to the atmosphere, thereby increasing the ratio of bits to liquid binder on the support surface.

Figure 7:
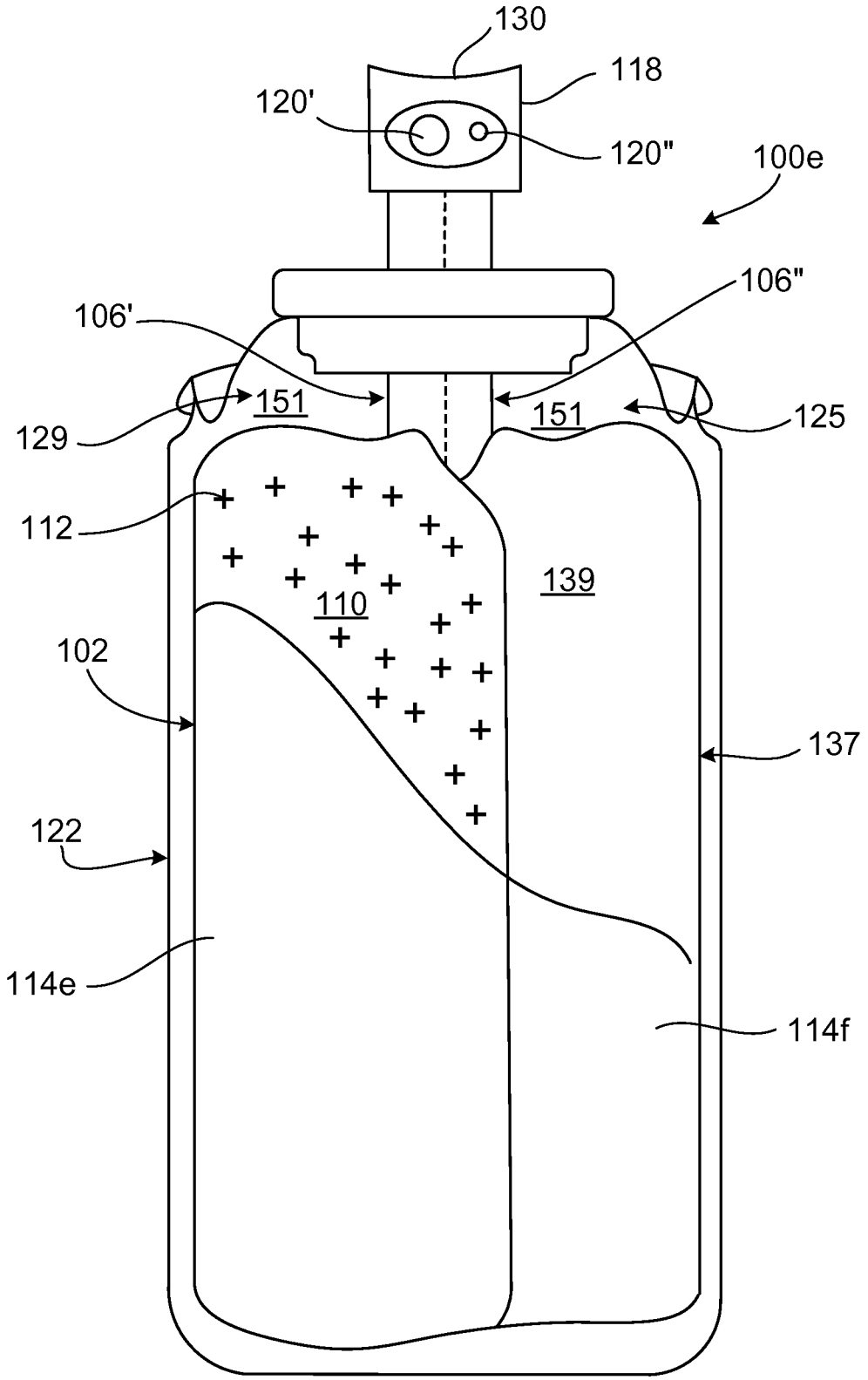
FIG. 7 is a cross-sectional view of a sixth particle sprayer.

FIG. 7 shows a particle sprayer 100*e* similar to the particle sprayer shown in FIGS. 6A and 6B. In this example, particle sprayer 100*e* has a particle source 102 in the form of a first reservoir 114*e* containing a quantity of particles 112 dispersed in a carrier fluid 110. The particle sprayer 100*e* also includes a fluid source 137 in the form of a second reservoir 114*f* containing a liquid binder 139. As shown, the reservoirs include flexible bags (in this example, hermetically sealed, multi-layered laminated pouches) disposed in a hollow cavity 125 of a sprayer body 122. A propellant 151 occupies the remaining space in the hollow cavity. Sprayer body 122 is hermetically sealed, such that propellant 151 pressurizes hollow cavity 125 and presses in on the first and second reservoirs. The reservoirs are placed in hydraulic communication with a spray outlet 104 by first a first conduit 106' and a second conduit 106" cooperating with a valve (not shown) for dispensing the particles and carrier fluid to the spray outlet. Spray outlet 104 features a nozzle 118 having an actuator 130 as well as a first orifice 120' and a second orifice 120" hydraulically coupled to first conduit 106' and second conduit 106", respectively. For some particle shapes and sizes discussed below, first orifice 120' should be provided having an open area of at least about 1.1 square millimeters. In this example, second orifice 120" is provided having a smaller open area than the first orifice. In some examples, second orifice 120" is provided having an open area of at least about 0.1 square millimeter.

Figure 8:
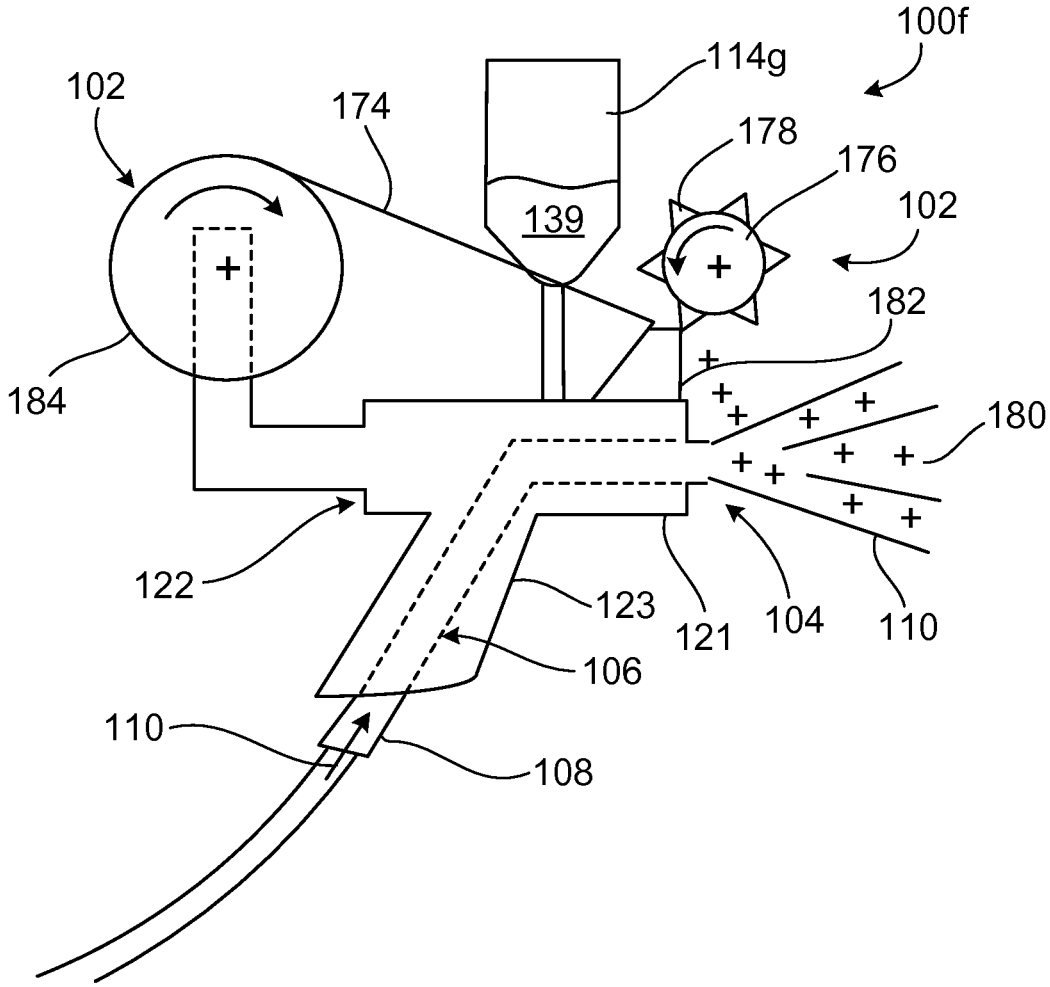
FIG. 8 is a schematic representation of a seventh particle sprayer.

FIG. 8 shows a schematic view of yet another particle sprayer 100*f*. In this example, the particle source 102 coupled to a spray outlet 104, a conduit 106 extending from a pressurized fluid inlet 108 to the spray outlet, and a reservoir 114*g* containing a liquid binder 139.

Particle source 102 includes a flexible ribbon of stock material 174 having a longitudinal axis, and a wheel 176 on which a multiplicity of cutters 178 are mounted for cutting through the ribbon at discrete intervals to form discrete fastening bits 180. Cutters 178 are mounted to the outer edge of wheel 176 and are configured to cut completely through the ribbon along the longitudinal axis. Ribbon 174 should be formed of a suitable material (e.g., thermoplastic) for forming discrete fastening bits, and may be of a cross-sectional shape chosen to provide overhanging projections on each severed bit.

Particle sprayer 100*f* further includes a support surface 182 (in this example, a bed knife) for supporting a distal end of ribbon 174 as discrete fastening bits 180 are severed. Support surface 182 may be formed of a much harder, wear-resistant material than cutters 178. For instance, in this example, the support surface is formed of carbide, and the cutters are formed of 303 stainless steel. Rotation of the cutting wheel may be sufficient to pull ribbon 174 from spool 184 to advance the ribbon during cutting. Alternatively, other ribbon feeding means may be provided, such as a feed nip between counter-rotating rollers or a feed belt (not shown).

Figure 9A:
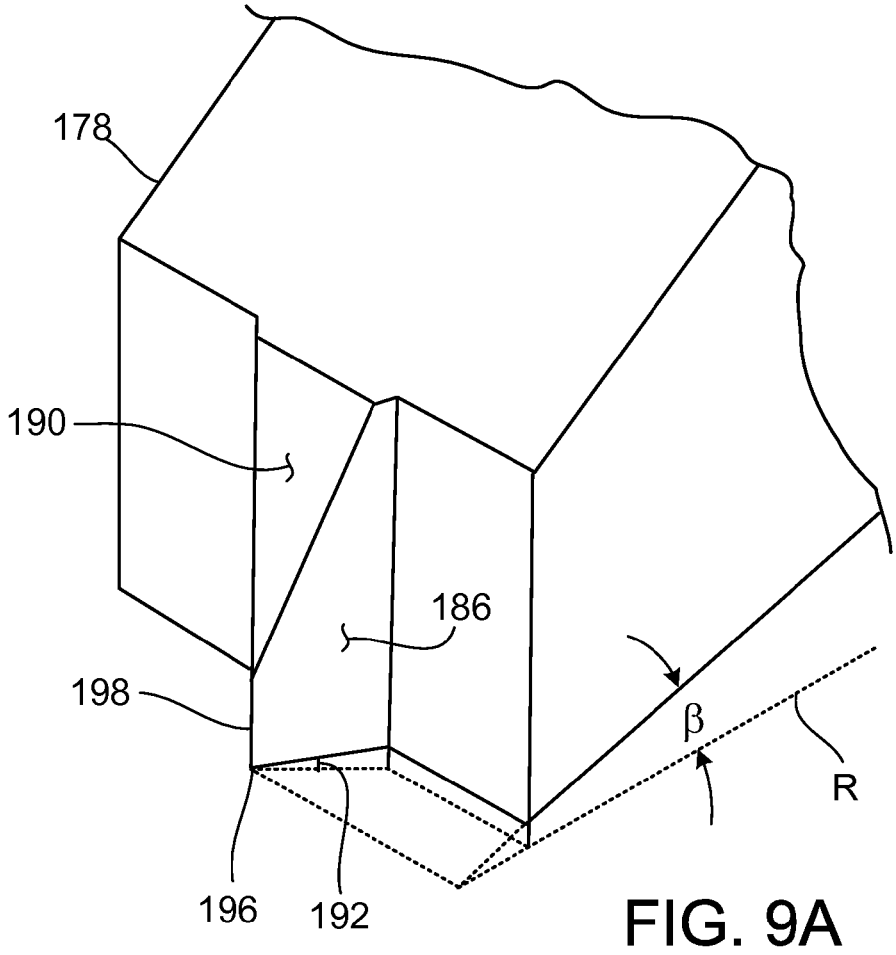
FIGS. 9A and 9B are a perspective and side views of a distal end of a cutter.
Figure 9B:
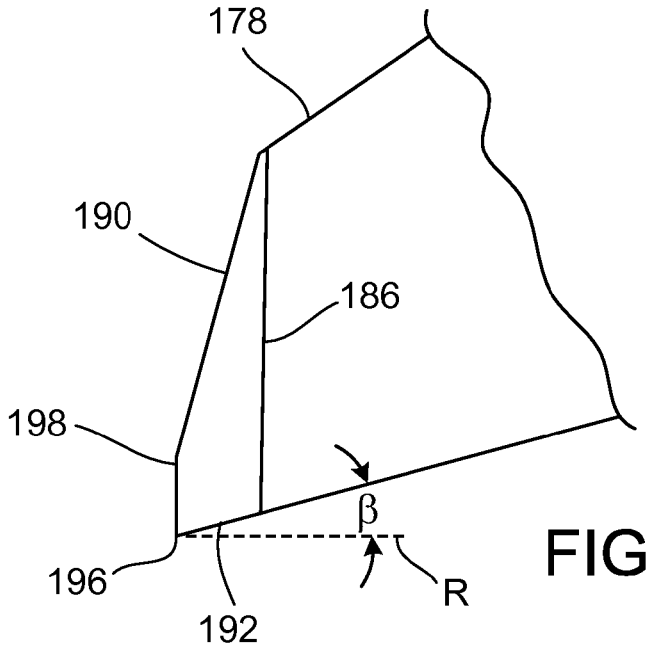

FIGS. 9A and 9B show the detail of one of cutters 178, which is formed to have a pointed projection 186 that engages and severs the ribbon. The trailing portion of projection 186 has a wedge-shaped relief 190, and the leading edge 192 of the projection defines a rake angle β with a radius R of wheel 176, such that the point 196 defined at the intersection of the radially distal edge 198 of the projection and leading edge 192 of the projection leads cutter 178 in its rotation. Distal edge 198 is shown essentially perpendicular to the cutting wheel radius from point 196 to the beginning of relief 190. Rake angles of about 20 to 25 degrees have been found to be appropriate with polyester ribbons. While this cutter 178 is shaped with an outwardly-directed projection for forming concave cuts in the ribbon, cutting may also be performed by a cutter defining a recess, such that the ribbon is first engaged on either lateral side by the advancing edges of the walls defining the recess. Such a cutter shape may help to trap the ribbon end as it is severed, forming convex surfaces on the exposed ribbon end.

When forming a touch fastener product, it may be required to provide a support surface with a mixture of particles (e.g., discrete fastening bits 180) and liquid binder having a high volumetric ratio of particles to binder. In some examples, having a high volumetric ratio of bits to binder ensures that a sufficient number of bit fiber snagging components (e.g., projection heads 210, see FIG. 11) are exposed for loop engagement. The proper coating ratio can be achieved by governing the density of the liquid binder. For example, when the bits are suspended in a foam carrier fluid, the volume taken up by the liquid binder in the carrier fluid is greatly enhanced for a given mass of the mixture. As the foam carrying the particles flows from of the orifice of a particle sprayer, the cell structure of the foam may be destroyed (i.e., the foam collapses, releasing its gas and leaving behind the liquid binder), such that the final coating on the support surface has the original density of the liquid binder in the carrier fluid. As such, many more bits per volume of carrier fluid can be deposited on the support surface when compared with an un-foamed carrier fluid. Likewise, in some examples, the carrier fluid is provided in the form of a liquid having a low volume of liquid binder (in some applications, a water based acrylic adhesive mixed with about 66.67% by volume of water). In such examples, when the coating is allowed to set on the support surface, the majority of the liquid in the carrier fluid evaporates and the final coating of the support surface has the original density of the liquid binder in the carrier fluid.

Figure 10:
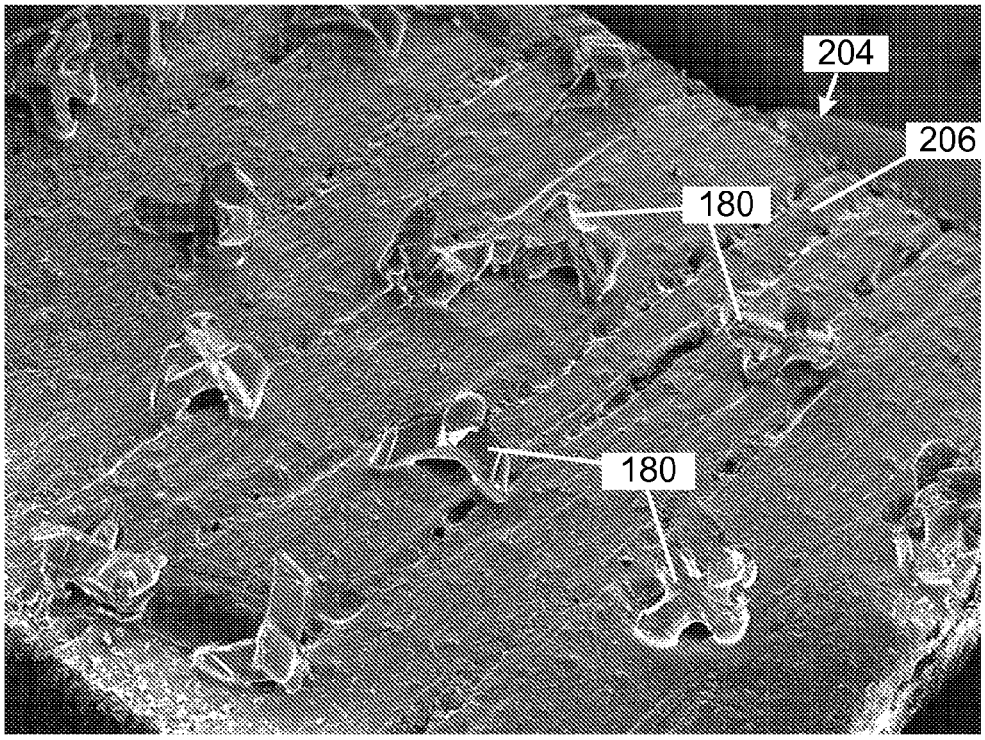
FIG. 10 is an enlarged photograph showing a perspective view of a surface of a touch fastener product to which a number of fastening bits are adhered.

As mentioned above, the particles 112 include discrete fastening bits. The discrete fastening bits 180 may be applied to a support surface to form a touch fastening product. FIG. 10 shows a touch fastener product 204 having a broad support surface 206, with a multiplicity of discrete fastening bits 180 dispersed across and fixed to the support surface 206 in various orientations. The bits 180 are dispersed in a random pattern, each bit being supported by surface 206 and generally separated from the other bits by varying distances. To give some sense of proportion, the bits 180 shown in FIG. 10 are each only about one millimeter across, from tip to tip.

Figure 11:
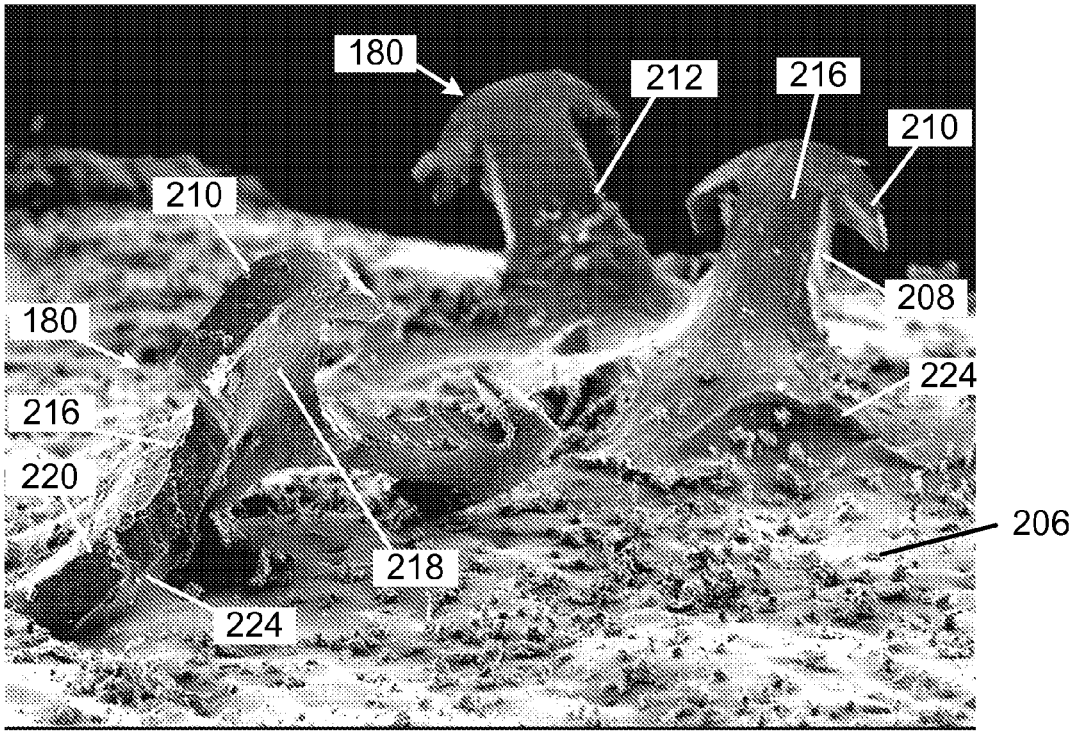
FIG. 11 is an even more enlarged view of a portion of the surface shown in FIG. 10.

FIG. 11 shows an even more greatly enlarged view of surface 206 and a few of the bits 180. Each bit 180 has multiple projections 208 extending in different directions, with at least one projection 208 of each bit extending away from surface 206. Each projection has a head 210 that overhangs the bit beyond the neck 212 of the projection, to define crooks 214 for the releasable engagement of fibers. Each bit 180 has two opposite side surfaces 216 and 218 that form boundaries of surfaces 220 that define the projections. Surfaces 220 form the perimeter or profile of each projection, and the opposite side surfaces 216 and 218 form the broad faces of the bits and their projections. Each of the bits has a thickness, measured between its opposite side surfaces 216 and 218, that is less than a maximum overall linear dimension of the bit. In the example shown, the thickness of each bit is only about 0.3 millimeter, while the maximum overall linear bit dimension, in this case measured between opposite projections, is about 1.0 millimeter, such that the ratio of thickness to maximum linear bit dimension is only about 0.3.

Each of the bits 180 shown in FIGS. 10 and 11 has four projections 208 extending in perpendicular directions, such that the bit has an overall shape similar to a '+' symbol, with rounded arrowheads on each projection. In this example, both of the opposite side surfaces 216 and 218 are non-planar, and are of complementary topography. The shape of the bits is such that, at rest on a planar horizontal surface, they will self-orient with at least one projection 208 extending away from the surface 206, to be available for loop engagement. The bits 180 shown in FIG. 11 each have a thickness, measured between their side surfaces 216 and 218, of about 0.102 millimeter. Bits of a similar profile but of about 0.3 millimeter in thickness, have been found to exhibit higher peel performance when mated with some loop materials.

Figure 12:
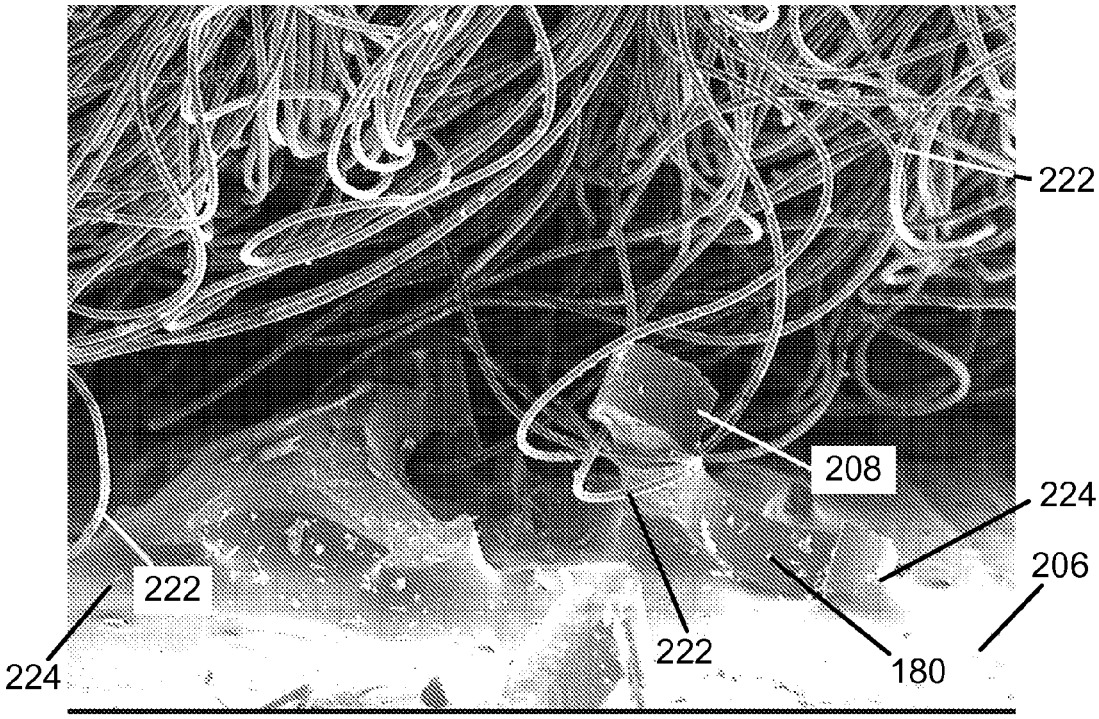
FIG. 12 is an enlarged photograph showing a few fastening bits of the surface of FIG. 10 engaging loop fibers of a mating fastener material.

Thus, as fixed to surface 206 and as shown in FIG. 12, each bit 180 is oriented with at least one of the projections 208 extending away from the support surface 206 for engaging loop fibers 222. In many cases, the projections themselves project at acute angles from the support surface 206, such that fibers may be snagged under the projection and/or in the crooks formed on either side of the projection. Furthermore, because the bits 180 are distributed randomly, the fastening properties of the overall touch fastener product are generally independent of engagement direction. For many touch fastener applications, the bits will be distributed with an average bit density of at least one bit per square centimeter, with all linear dimensions of the bit being less than about 1.2 millimeters (in some cases, 0.25 millimeter or less across). For some applications, bit densities between about 8 and 15 bits per square centimeter are preferable, with bits of such small size. For some other applications, bits as large as, for example, three millimeters across, are useful. While it may be, due to the random distribution of the bits, that some bits become fixed to the surface in contact with other bits, in most cases it is preferable that the bits be spaced from other bits so that the presence of other bits does not impede the engagement of fibers by the exposed projections.

As can be seen in FIGS. 11 and 12, each bit is permanently fixed to support surface 206 by an adhesive 224 into which lower portions of each bit are embedded. While the degree of wetting on the surfaces of the bits, and the amount of each bit that remains exposed will vary, in this example most bits have three out of four projections directly adhered to surface 206, leaving only one projection 208 of each bit exposed for engagement. With some other bit shapes (to be discussed further below), more than one projection of each bit will, on average, remain exposed for engagement.

Figure 13:
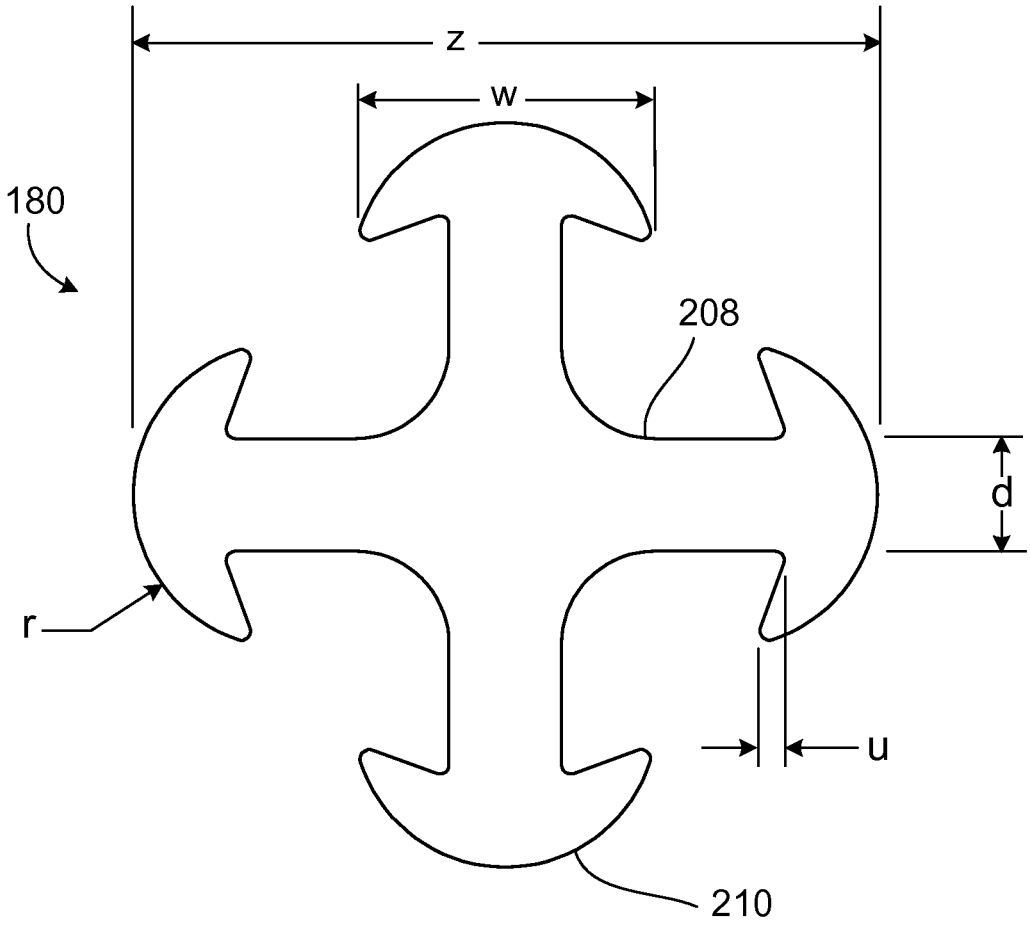
FIG. 13 is a front view of a fastening bit.

The projected profile of each bit, as seen from one of its opposite side surfaces, is shown in FIG. 13. Each projection 208 ends at a head 210 that has an overall width 'w' of about 0.4 millimeter and a curved outer surface of radius 'r' of about 0.2 millimeter, overhanging a projection neck of a width 'd' of about 0.15 millimeter. The underside of each head forms two opposite loop-retaining crooks, the edges of each head extending back toward the bit a distance 'u' of about 0.033 millimeter. The maximum lateral dimension 'z' of the bit, measured from outer head surfaces, is about 1.02 millimeter.

Bits of non-planar opposite side surfaces of complementary topography may be formed by cutting the bits from a shaped ribbon (e.g., ribbon 174 of FIG. 8) with a series of identical cuts, each cut simultaneously forming an opposite side surface 216 of one bit and an opposite side surface 218 of another bit. The ribbon shape and material resiliency may be chosen such that the process of cutting bits from the rail imparts further geometric properties. For example, as a cutter (e.g., cutter 178 of FIGS. 9A and 9B) enters the material, force from the cutter compresses the material of the ribbon, which remains compressed during cutting. Because the ribbon material is resilient, after a bit is severed from the rail its severed surface obtains a curvature perpendicular to the path of the cut, due to relaxing of the compressed bit material. Thus, curvature in one plane can be provided by cutter shape, while curvature in a perpendicular plane can be provided by compression during cutting, and curvature in yet another perpendicular plane can be provided by ribbon shape. In this manner, bit geometry may be altered in essentially any orthogonal direction.

Furthermore, the resulting geometry of each cut can be modified by adjusting the unsupported length of ribbon extending between the end of its support surface and the cutter. For example, spacing the cutter wheel so as to engage the ribbon beyond the end of its support will cause the unsupported length of rail to be resiliently deflected during cutting by bending forces induced by the cutting, such that, after the cutting, the unsupported length of ribbon returns to a position, prior to a subsequent cut, in which an edge of the ribbon corresponding to an exit point of the cutting extends farther in a longitudinal direction than an edge of the ribbon corresponding to an entrance point of the cutting. However, for many applications it may be preferable to reduce or eliminate any unsupported length of ribbon during cutting.

While the cutting patterns described above may be performed by linear reciprocation of a cutter blade, they may also be formed by a rotating cutter wheel (e.g., wheel 176). The methods of bit severing described herein may be employed to produce discrete bits that are then assembled into, or fed to, the various sprayers discussed above.

Figure 14:
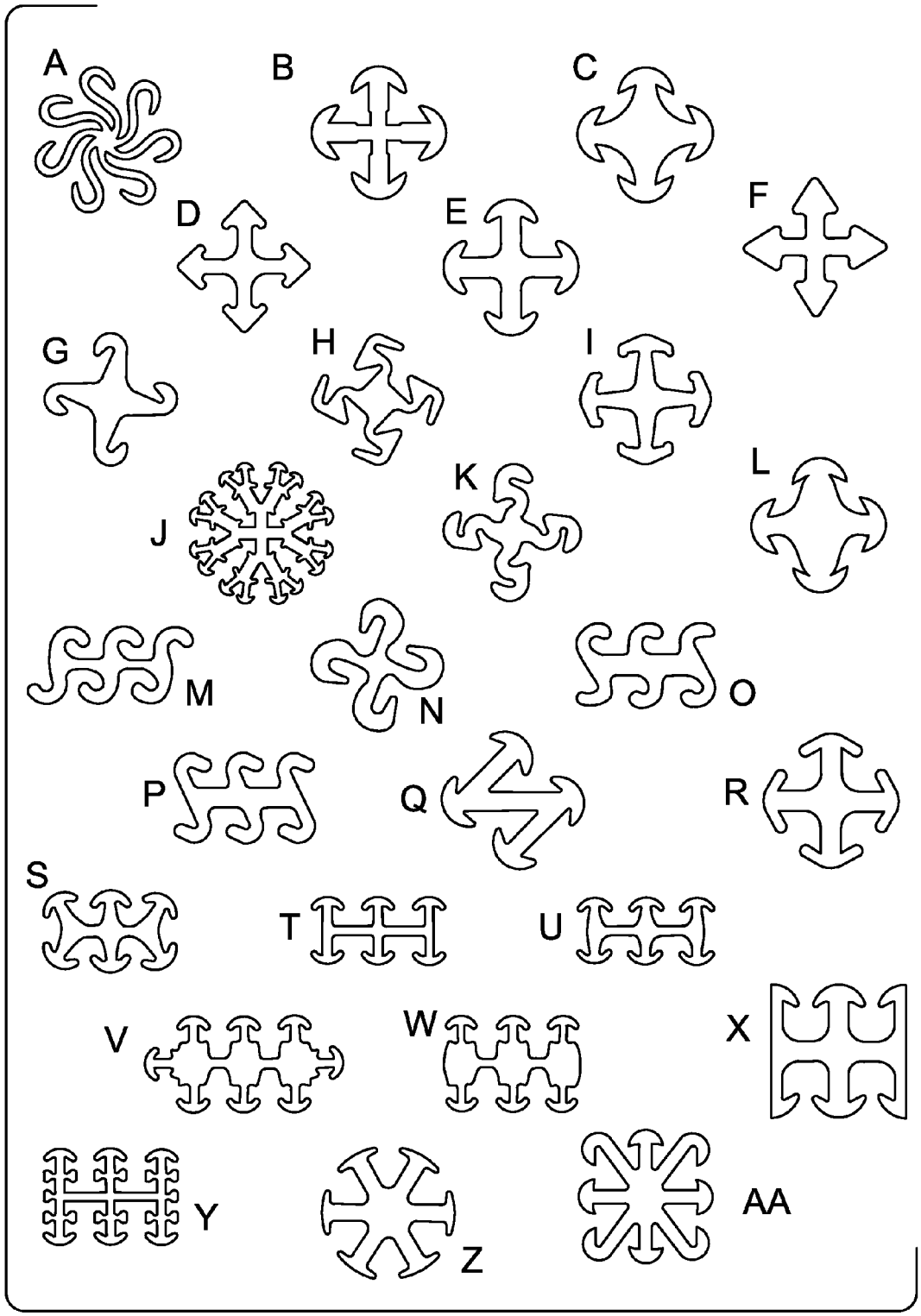
FIG. 14 shows 27 different ribbon cross-sectional shapes, from which bits may be cut, the shapes labeled A through AA.

FIG. 14 shows several examples of cross-sections that may be continuously extruded to form ribbons from which bits may be severed. Each cross-section shown in FIG. 14 represents a constant ribbon cross-section, with the outline of the profile representing the projection-defining surfaces that extend continuously along the length of the ribbon and maintain their as-extruded nature in the severed bits. Many shapes, like those labeled B-I, K, L, N and R, have four projections, each extending from a common hub generally perpendicular to two adjacent projections. In many of those, the projections are all identical. Shape L shows an example in which the projections are not all identical. Many, such as shapes B-F, I, L and R-Z, are symmetric about each of two axes (one vertical and the other horizontal as illustrated). Shape L, for example, is stiffer with respect to compression in the vertical direction, so as to withstand cutter load without buckling. Some, such as shapes M, O, P, S-W and Y, have both a major axis and a minor axis perpendicular to their longitudinal axis, with the cross-section longest along its major axis. With such shapes it is preferred that the cutting occur along the direction of their minor axis. Many of the shapes with major and minor axes of different dimensions have projection extending in only two opposite directions, such as in shapes M, O, P, T, U and W. Shapes S and Z each have six projections, each extending in a different direction, and shape AA has eight projections each extending in a different direction. Shape V is similar to shape W, but with the addition of projections extending from either end along the major axis. Shape Y has six primary projections extending in the direction of its minor axis, the neck of each primary projection carrying a pair of secondary projections extending in the direction of its major axis. Shape J has four primary projection groups, each group including several branches that form discrete projections, such that the outer periphery of the bit has 16 separate heads for engaging loop fibers, while additional features on the sides of the projection stems form even more engagement points. Many of the shapes have projections with heads that overhang their stems on both sides of the projection, such as those in shapes B-F, H-L, Q-W, Y and Z, and some of the projections of shapes X and AA. Other projections, such as those of shapes A, G and M-P, and some of those of shapes X and AA, have heads that overhang to engage fibers on only one side of their stem. In some shapes, such as shapes H and K, the projections each overhang in two directions, but at different distances along the projection, such that each projection defines two fiber-retaining crooks, one nearer the central hub of the bit than the other. In shape Z the heads overhang both sides of the projection stems to form crooks, but with no return of the tips of the head toward the hub of the bit, such that the underside surfaces of the heads are essentially flat and perpendicular to the adjacent projection stems surfaces. In shape Q projections extend at acute angles up and down from a central web (shown horizontal in the figure), the ends of which are also equipped with overhanging heads for loop engagement, such that the overall cross-section of the ribbon has the general appearance of a letter 'N' or 'Z'. This shape also provides for some vertical collapse during cutting, the upper and lower arms of the shape elastically compressing against the central web to support the arms during cutting. In most of the illustrated shapes the outer surfaces of the projection heads are rounded, while the heads of shapes D and F are generally pointed. The various projections shown in these shapes are designed to have particular engagement and disengagement properties. For example, the heads of the projections of shape Z are designed to snag very low-loft fibers, such as those of non-woven materials, while the heads of the projections of shape N are designed to engage with high-loft loops and to aggressively retain the loop fibers once engaged, without distending. Of course, many other ribbon shapes, and corresponding bit shapes, are useful.

Figure 15A:
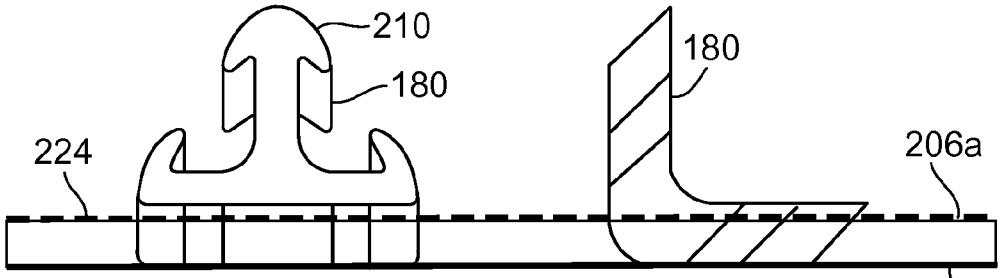
FIGS. 15A-15E show, in side view, five different stable bit orientations upon a surface.
Figure 15B:
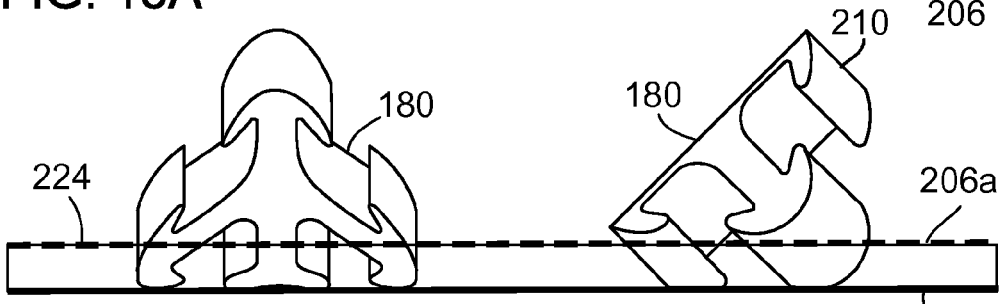
Figure 15C:
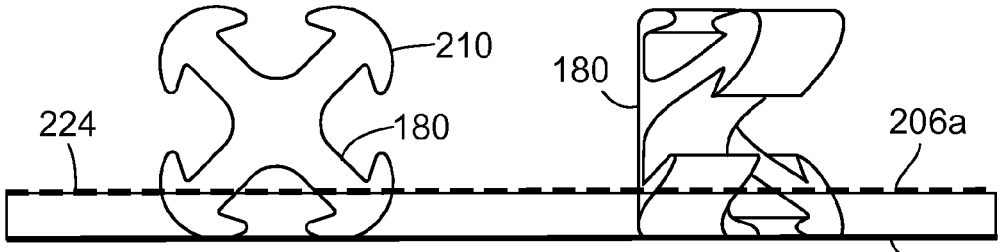
Figure 15D:
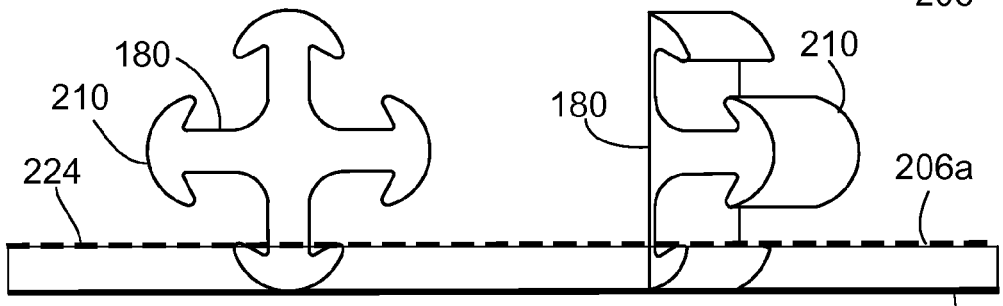
Figure 15E:
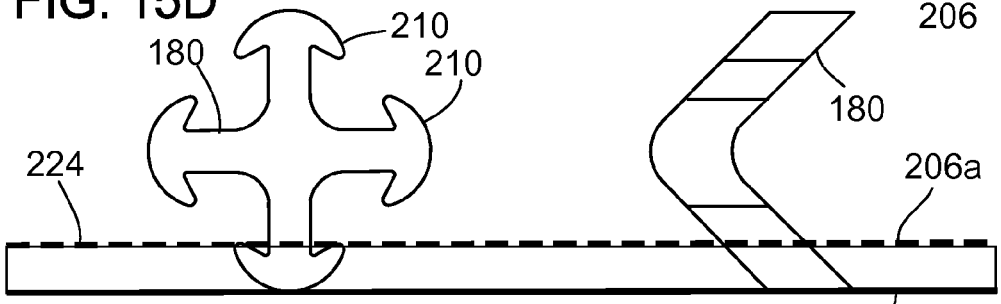

Referring next to FIGS. 15A and 15E, when bits 180 are randomly distributed over a horizontal support surface 206, and rest on that surface only under their own weight, they may assume any one of the orientations shown in these figures. All of these orientations have in common that at least one projection head 210 of the bit is raised from surface 206 for loop fiber engagement. In the orientation shown in FIG. 15A, the bit is resting on a portion of its convex side surface, with one projection flat against surface 206 and the heads of two other projections in contact with surface 206. One projection extends away from surface 206, its head 210 fully raised or spaced from surface 206 for loop fiber engagement. Because the convex side surface of bit 180 defines essentially a 90-degree angle, the upwardly extending projection extends essentially perpendicular to surface 206. In the orientation of FIG. 15B, bit 180 is resting on three of its projection heads, with the fourth projection head 210 extending away from, and raised from, surface 206 for fiber engagement. Due to the shape of the bit, the upper projection extends at an acute angle to the surface. As seen from FIGS. 10-12, when broadcast over a surface many of the bits assume this particular orientation. In general, the shape and structure of the bits are stable as cut, prior to being distributed onto the surface. The bits are not applied to the surface in liquid form, nor do they obtain their individual shape by influence of gravity or the surface itself. In this sense they may be considered rigid bodies in comparison to the adhesive bonding them to the surface.

FIGS. 15C-15E illustrate three other potential orientations that may be assumed by a bit 180 at rest on a horizontal surface 206. The incidence of the orientation shown in FIG. 15C, in which two heads 210 are raised at the distal ends of two projections extending at acute angles relative to surface 206, is a function of the thickness of the bit, relative to other geometric properties and linear dimensions, with a thicker bit (e.g., one resulting from a higher rail advance rate between successive cuts) more frequently assuming this orientation than a thinner bit cut from the same rail. The orientations of FIGS. 15D and 15E may be considered stable orientations only in the presence of an adhesive mechanism. In these two orientations, three engageable heads 210 are raised, one on a vertically-extending projection and two on horizontally-extending projections. Even in these three orientations, at least one projection head 210 is raised from surface 206 for loop fiber engagement.

Figure 16:
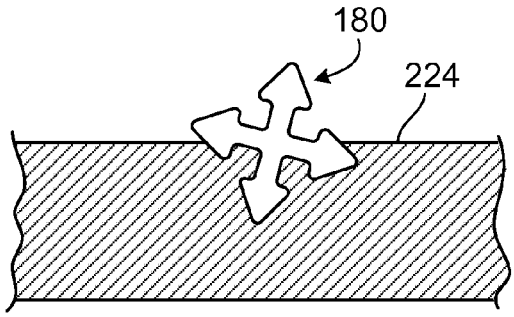
FIG. 16 shows a bit partially submerged in an adhesive coating.
Figure 17:
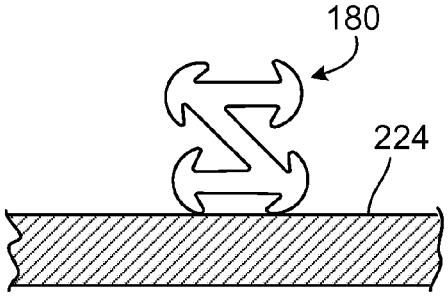
FIG. 17 shows a bit floating on an adhesive coating.

The dashed lines shown in FIGS. 15A-15E represent an upper surface of an adhesive 224 fixing the bits 180 in these orientations. The dashed lines are also labeled as 206*a* to illustrate that "surface" over which the bits 180 are sprayed may be a surface 206*a* of a layer of adhesive disposed on a substrate 206. The bits 180 may be partially embedded in adhesive 224 as shown in these illustrations and in FIG. 16, or float on the adhesive surface as in FIG. 17. The adhesive 224 may be in place before the bits are sprayed, or may be delivered to the surface with the bits.

Figure 18A:
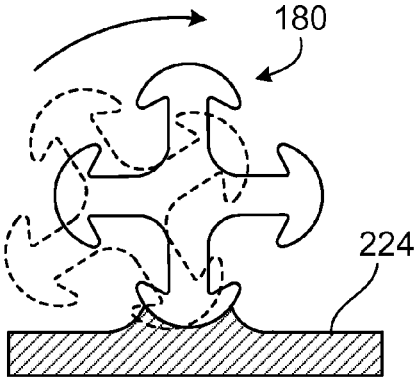
FIG. 18A illustrates a bit being righted by adhesive surface tension forces.

Even with relatively thin bits 180, the orientations shown in FIGS. 15D and 154E have been observed occurring as a result of surface tension or capillary forces at the surface of a liquid adhesive. This phenomenon is illustrated in FIG. 18A, which shows bit 180, which initially is oriented as shown by dashed outline, righting itself due to forces at the interface between the adhesive 224 and the projection head 210 in contact with the adhesive. This phenomenon appears more frequently with very light/small bits 180 and high wetting properties between the adhesive and bit materials.

Figure 18B:
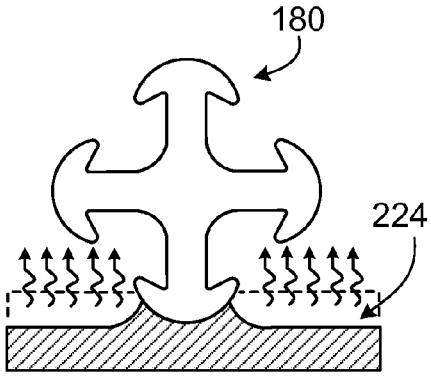
FIG. 18B shows an adhesive coating being thinned through evaporation.

Once applied to the surface, the thickness of the adhesive 224 may be reduced by drying. In this manner, low solids water-based adhesives may be applied as coatings thicker than would otherwise be tolerable in the finished product. FIG. 18B illustrates water or solvent evaporating from the adhesive, leaving an adhesive with a higher proportion of solids fixing the bit to the surface.

Similarly, the bits may be fixed to a surface, such as to a film or other solidified resin layer, by at least partially melting the surface after the bits are sprayed onto the surface. For example, bits may at first rest on the surface of a solidified adhesive 224 (or film surface) as in FIG. 17, and then become partially embedded in the adhesive 224 as the adhesive is melted, such as to either be suspended within the adhesive (as in FIG. 16, for example), or to come to rest on an underlying substrate (as, for example, in FIG. 15A). In such cases it will generally be the case that the resin from which the bits are formed is chosen to not melt under the conditions required to melt the surface onto which the bits are sprayed. Such conditions could be elevated temperature, or energy supplied by radiation or other means, such as sonic vibration.

In some embodiments, a component of the bits 180 (e.g., a projection head 210) is provided with either a much higher or much lower affinity to the adhesive 224 than the rest of the bits 180. In the case of high affinity, that component may then serve as the anchor for a coating of the adhesive 224 that would otherwise not wet onto the bit. Conversely, in the case of low affinity, that same component may serve as an exposed, fiber snagging portion for a coating of the adhesive 224 that would otherwise completely cover the bit.

In some embodiments, the bits 180 have either positive or negative buoyancy in a coating of adhesive 224. When the bits 180 are provided having a positive buoyancy, they may be completely encapsulated in the adhesive coating when sprayed on the support surface 206 (e.g., a floor surface) but float upwards to expose one or more of the fiber engaging projection heads 210. When the bits 180 are provided having a negative buoyancy, they may be completely encapsulated in the adhesive coating when sprayed on the support surface 206 (e.g., a ceiling surface) but sink downwards to expose one or more of the fiber engaging projection heads 210.

Figure 19:
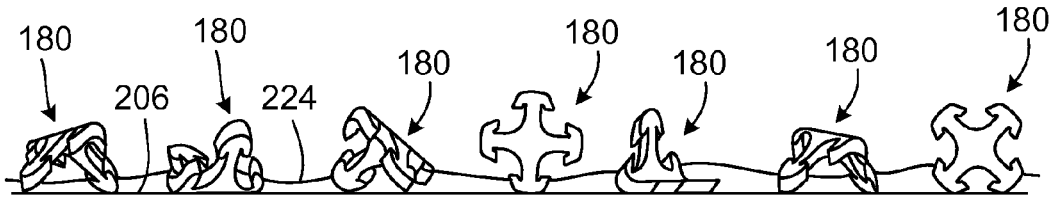
FIG. 19 shows a plurality of bits applied to a support surface.

FIG. 19 shows an additional illustration of a plurality of bits 180 applied to a support surface 206. As was mentioned above, the bits are adhered to the support surface 206 by adhesive 224 and are oriented having at least one projection head 210 available for loop fiber engagement.

Figure 20A:
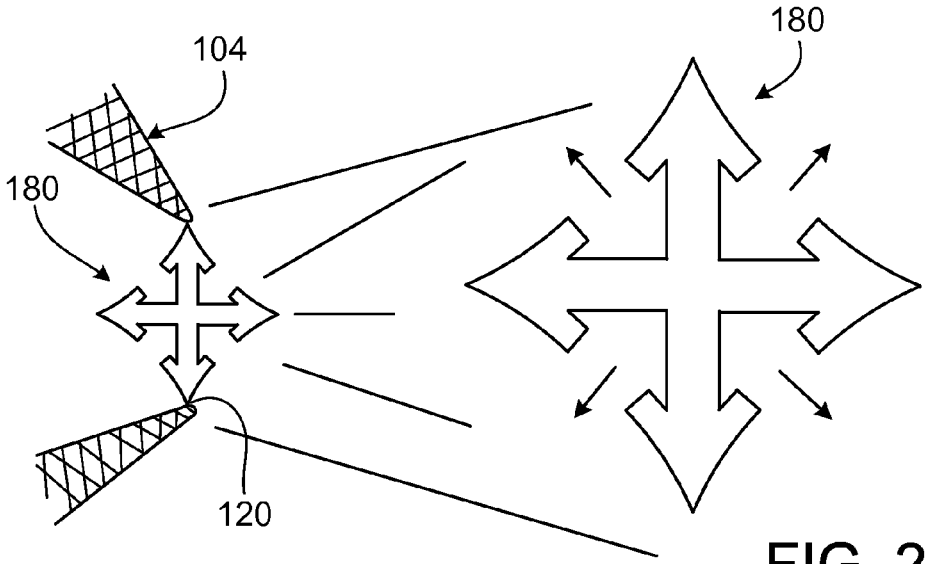
FIGS. 20A through 20C illustrate three different modes of discharging bits from an orifice smaller than the bit.

As discussed above referring to FIGS. 10-19, discrete fastening bits 180 may be configured for loop fiber engagement. The bits should also be configured for ejection from an orifice 120 of a particle sprayer 100. In some examples, discrete fastening bits 180 are configured for ejection from an orifice 120 having a relatively small diameter. FIG. 20A shows a compressible bit 180 being discharged from an orifice 120 of a spray outlet 104. The bit is formed of a material including a compressible substance (in this example, expanded polystyrene, however, melamine and urethane foam materials may also be suitable) such that the internal pressure of the reservoir in which the bit 180 is contained (e.g., reservoir 114*d*, see FIGS. 6A and 6B) compresses the bit to a suitable size for being ejected from orifice 120. Once bit 180 is free of orifice 120, it expands in the lesser atmospheric pressure to a larger size for snagging fibers.

Figure 20B:
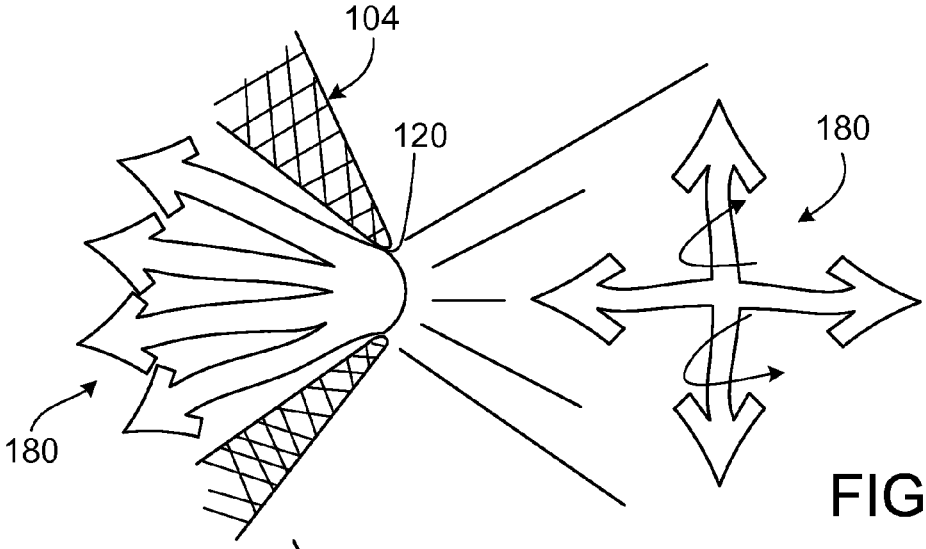

FIG. 20B shows a highly elastic bit 180 being discharged from an orifice 120 of a spray outlet 104. The bit is formed of a material including a highly elastic substance (e.g., the bit may have very little central mass and high aspect ratio projections). As shown, the undistorted dimensions of bit 180 would not allow it to be ejected from orifice 120. Due to its highly elastic composition, however, the bit may be contorted and deformed to fit through orifice 120 under force of the flow of carrier fluid, and will elastically rebound to its original shape after ejection.

Figure 20C:
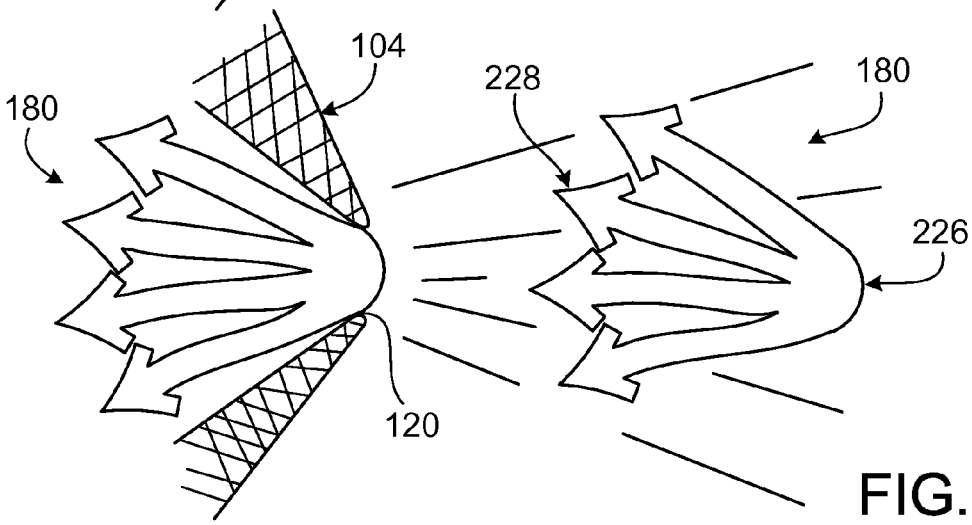

FIG. 20C shows a plastically deformable bit 180 being discharged from an orifice 120 of a spray outlet 104. Again, as shown, the undistorted dimensions of the bit would not allow it to be discharged from orifice 120. Bit 180, however, may be plastically contorted and deformed to fit through orifice 120. The formable bit may retain at least some of its deformation after ejection, allowing curvature developed during ejection to assist in its orientation on the support surface. Additionally, bit 180 as deformed may be aerodynamically aligned for self-orientation onto a support surface 206 when sprayed in a carrier fluid. For example, the deformation of bit 180 may provide an aerodynamic leading end 226 for adhesion to the support surface and an aerodynamic trailing end 228 having projection heads 210 for engaging fibers.

Figure 21A:
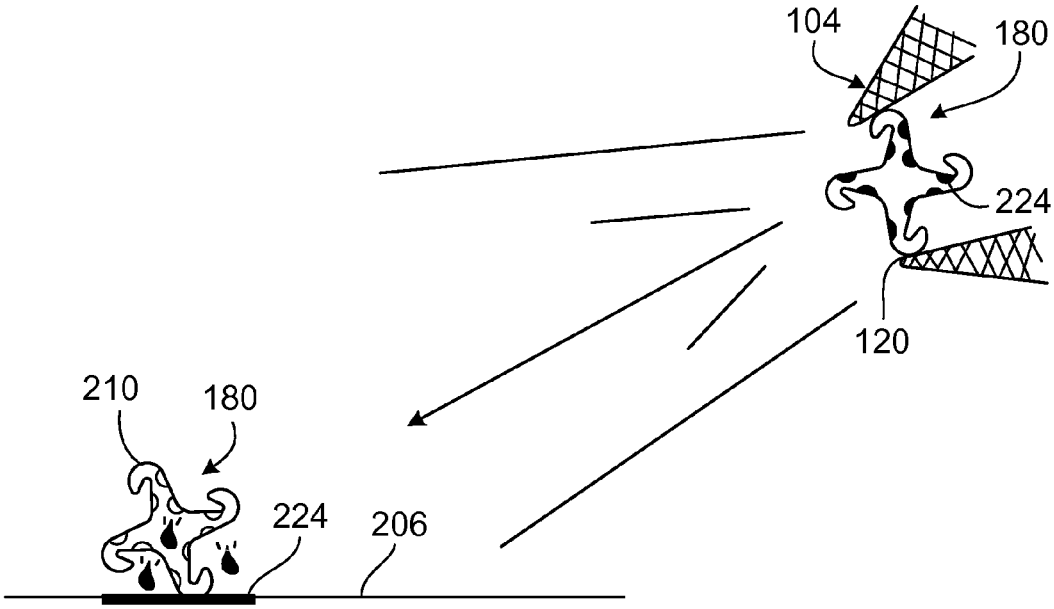
FIGS. 21A through 21C illustrate three different modes of discharging a bit with discrete quantities of adhesive from an orifice of a particle sprayer onto a support surface.
Figure 21B:
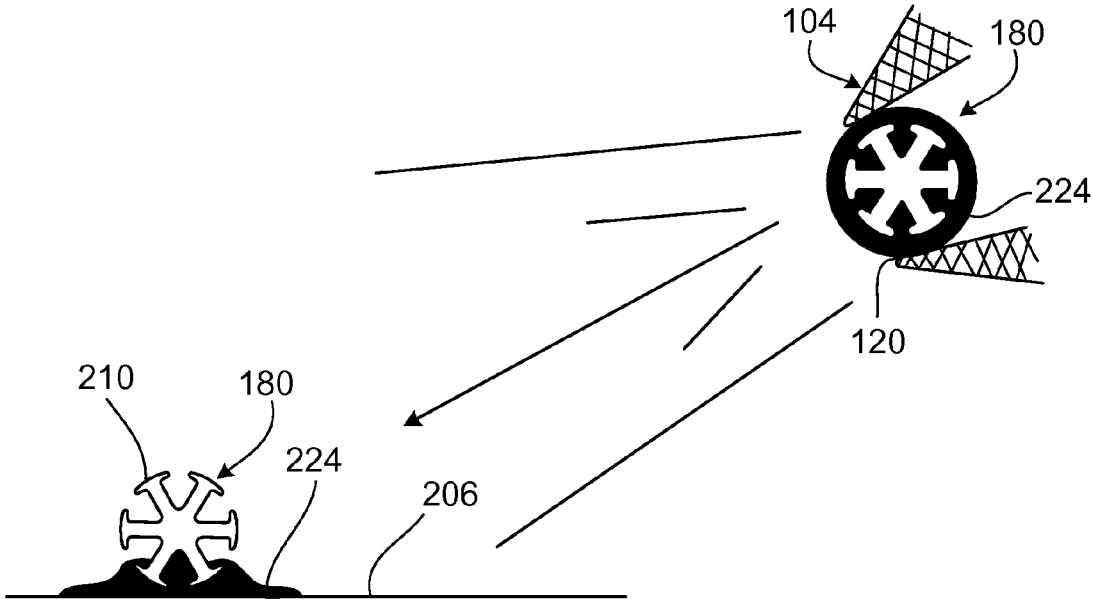
Figure 21C:
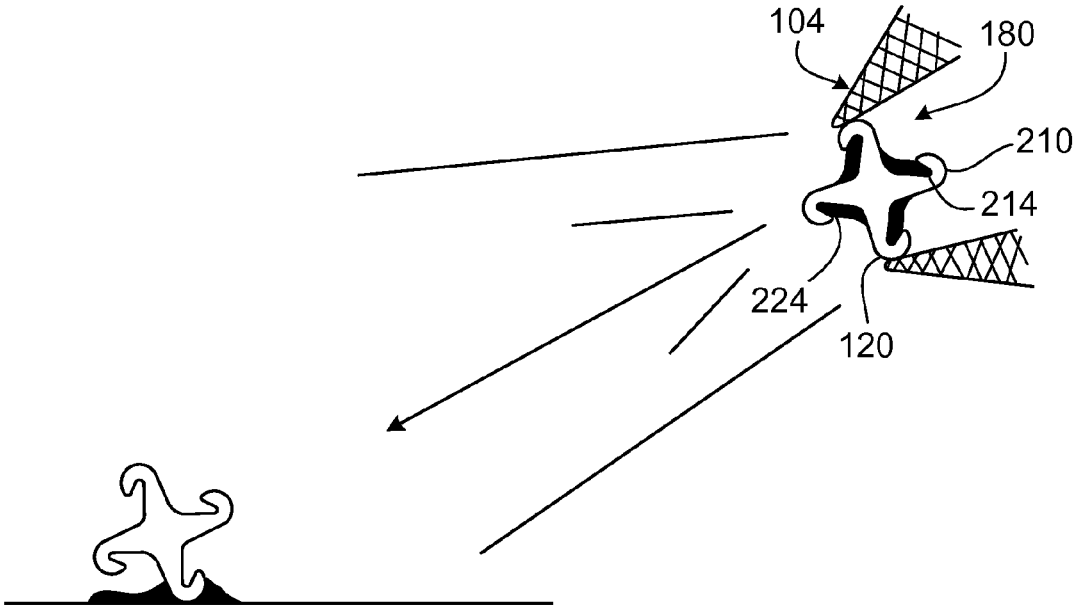

FIGS. 21A-21C show a bit 180 being discharged from an orifice 120 of a spray outlet 104 with discrete quantities of adhesive 224. Spraying the bits such that the adhesive is only provided where the bits land can allow the support surface to which the bits are adhered to maintain its permeability, stretchability, or other similar properties.

FIG. 21A shows a bit 180 having voids or pockets in which a quantity of adhesive 224 is disposed. In this example, adhesive 224 includes a foaming agent such that the adhesive filing the pockets of the bit is an unstable foam (e.g., a water based acrylic). After bits 180 have impacted support surface 206, the foam collapses to allow adhesive 224 to vacate the pockets of the bit and flow onto the surface to fix the bit to the support surface. In some cases, the impact against surface 206 collapses the foam or otherwise ejects the adhesive from the bit.

FIG. 21B shows a bit 180 encased in an adhesive 224. After the encased bit impacts surface 206, adhesive 224 is made to flow from the bit onto the surface to expose at least some of the projection heads 210 for engagement and to fix the bit to the surface, such as by melting of the adhesive.

FIG. 21C shows a bit 180 with adhesive 224 collecting or clumping on its surface such that the bit is propelled toward a support surface 206 with little or no loose liquid (i.e., liquid not attached to the bits) in the spray. More specifically, as shown, adhesive 224 has accumulated in crooks 214 defined by projection heads 210. In some other examples, one or more portions of the bit are provided having a higher affinity for the adhesive (e.g., wettability) than other portions of the bit, thereby causing the adhesive to wet only those portions of the bit having the high affinity. Or in some cases the entire surface of the bit is formed to have a high affinity to the adhesive, such that the adhesive tends to wet, and stick to, the surface of the bit. In still some other examples, the nozzle of spray outlet 104 is configured to release relatively large droplets of adhesive 224 with bits 180 in order to avoid having loose liquid in the spray. The resulting spray pattern may be particularly useful when spraying bits onto a permeable fabric, for example, so as to not impair the permeability of the overall fabric by flooding with the adhesive. Similarly, a stretchable material may retain its overall stretch properties even when adhering bits in small amounts of even a non-stretchable adhesive.

While a number of examples have been described for illustration purposes, the foregoing description is not intended to limit the scope of the invention, which is defined by the scope of the appended claims. There are and will be other examples and modifications within the scope of the following claims.

What is claimed is:

1. A particle sprayer, comprising:

a reservoir containing a multiplicity of particles;

a valve in hydraulic communication with the reservoir for dispensing particles from the reservoir; and a spray outlet coupled to the reservoir for spraying particles dispensed by the valve;

wherein the particles comprise discrete fastening bits, each bit having one or more projections, and each projection having an overhanging head for snagging fibers.

2. The particle sprayer of claim 1, wherein the reservoir also contains a quantity of carrier fluid in which the particles are sprayed from the sprayer.

3. The particle sprayer of claim 2, wherein the carrier fluid is pressurized within the reservoir.

4. The particle sprayer of claim 2, wherein the carrier fluid is motivated by a propellant also contained within the reservoir.

5. The particle sprayer of claim 2, wherein the carrier fluid comprises an adhesive formulated to bond the sprayed particles onto a surface onto which they are sprayed.

6. The particle sprayer of claim 2, wherein the particles are suspended within the carrier fluid within the reservoir.

7. The particle sprayer of claim 2, wherein the carrier fluid is in liquid form within the reservoir.

8. The particle sprayer of claim 1, wherein the bits are larger, in an unstressed state, than the spray outlet.

9. The particle sprayer of claim 1, wherein the bits are porous.

10. The particle sprayer of claim 1, wherein the bits are configured to self-orient upon spraying, such that the bits tend to land on a support surface in a particular orientation when sprayed.

11. The particle sprayer of claim 1, wherein each bit comprises a quantity of an adhesive that releases upon impact with a support surface.

12. The particle sprayer of claim 1, wherein each bit comprises opposite side surfaces defining the projections, and wherein at least one of the opposite side surfaces of each bit is non-planar.

13. A particle sprayer, comprising:

a particle source comprising particles, wherein the particles comprise discrete fastening bits having one or more projections, and each projection having an overhanging head for snagging fibers;

a spray outlet coupled to the particle source; and a conduit extending from a pressurized fluid inlet to the spray outlet and configured to constrain a flow of carrier fluid to flow along the conduit toward the spray outlet to propel the particles from the particle source away from the spray outlet.

14. The particle sprayer of claim 13 further comprising an impeller operable to motivate air through the spray outlet to propel the particles away from the sprayer.

15. The particle sprayer of claim 13, wherein the particle source is releasably coupled to the spray outlet.

16. The particle sprayer of claim 13, wherein the particle source comprises a reservoir containing a quantity of the particles.

17. The particle sprayer of claim 16, further comprising a venturi constriction in hydraulic communication with the reservoir for siphoning particles from the reservoir.

18. The particle sprayer of claim 13, further comprising a fluid source coupled to the pressurized fluid inlet.

19. The particle sprayer of claim 13, wherein the particle source comprises a longitudinally continuous ribbon and a cutter operable to cut through the ribbon at discrete intervals to form the discrete fastening bits.

* * * * *